US005168719A

United States Patent [19]

Branz et al.

[11] Patent Number: 5,168,719

[45] Date of Patent: Dec. 8, 1992

[54] FOOD PREPARATION TABLE WITH OPEN AIR FOOD STORAGE

[75] Inventors: Michael A. Branz; Ralph A. Fuhrmann, Jr., both of Spartanburg; Dan G. Hopkins; Harry A. Brancheau, both of Inman, all of S.C.

[73] Assignee: Specialty Equipment Companies, Inc., Berkeley, Ill.

[21] Appl. No.: 813,384

[22] Filed: Dec. 24, 1991

[51] Int. Cl.[5] ..... F35D 23/12

[52] U.S. Cl. ..... 62/258; 62/256

[58] Field of Search ..... 62/256, 258, 261

[56] References Cited

U.S. PATENT DOCUMENTS 2,661,114 12/1953 Barnett et al. ..... 220/252
3,675,438 7/1972 Takemasa et al. ..... 62/180 X
4,449,374 5/1984 Ibrahim ..... 62/256 X

*Primary Examiner*—William E. Tapolcai
*Attorney, Agent, or Firm*—Dority & Manning

[57] ABSTRACT

A food preparation table includes a cabinet with a food preparation surface and a heat-insulated food storage compartment. An evaporator and a fan are disposed inside the cabinet so that air moves through the evaporator upon operation of the fan. In one embodiment, a temperature controller operates the evaporator fan only during operation of the refrigeration equipment in the cooling mode. A condiment plenum is disposed adjacent to the preparation surface and includes at least one condiment plenum wall that defines a complex structure. At least one open top condiment pan is received by the condiment plenum. A cool air supply system, which can include an auxiliary fan, one or more baffles, and air flow dams and guides, efficiently distributes cool air from a localized site, to widely dispersed locations, some of which being inside the storage compartment and some of which being exposed to the ambient atmosphere. A return air system efficiently collects relatively warmed air from widely dispersed locations and returns it to a localized site where the air can be efficiently recooled.

29 Claims, 9 Drawing Sheets

FOOD PREPARATION TABLE WITH OPEN AIR FOOD STORAGE

BACKGROUND OF THE INVENTION

The present invention relates to food preparation tables and more particularly to such tables including at least one refrigerated storage compartment beneath the food preparation surface and condiment pans disposed adjacent the food preparation surface.

As the ingredient foodstuff items in the condiment pans may be present in the pans for many hours before being used by the food service worker who is preparing the desired prepared foodstuff, such as pizza or sandwiches, it becomes desirable to keep the ingredient foodstuffs refrigerated at temperatures between 32° and 40° F. Since the ingredient foodstuffs in the condiment pans must be readily available to the food preparer, the condiment pans are not sufficiently accessible if they are enclosed in a refrigerated compartment having a door which must be opened to gain access to the ingredient foodstuffs and closed to keep the ingredient foodstuffs sufficiently cold.

Devices which rely on cold wall refrigeration enclosures for cooling the condiment pans are prone to produce undesirable temperature gradients in the condiment pans. These gradients cause portions of the foodstuffs to become frozen in order to keep other portions of the foodstuffs at acceptable cooling temperatures.

A number of devices use forced cool air circulation beneath the space occupied by the condiment pans. Examples of such devices are described in U.S. Pat. No. 4,802,340 to Johnson; U.S. Pat. No. 4,457,140 to Rastelli; and U.S. Pat. No. 2,886,395 to Cahn. However, recently the National Sanitation Foundation has promulgated a very strict performance standard for certification of food preparation tables. In an attempt to meet these new standards, one device shown in U.S. Pat. No. 4,685,311 to Rastelli forces cool air from the evaporator to a position well above the open tops of the pans and releases the cooled air to drop down vertically onto the upper surface of the food stored in the pans. However, the movement of cooled air over such long distances is inefficient, as is the cooling of the air space above the pans and the collection of the air for return to the evaporator. Moreover, forced air systems can suffer erratic temperature gradients because of the difficulty of evenly distributing the cooled air throughout the entirety of the refrigerated space.

OBJECTS AND SUMMARY OF THE INVENTION

It is a principal object of the present invention to provide an improved food preparation table.

It is a further principal object of the present invention to provide a food preparation table which efficiently meets the tougher new performance standards of the National Sanitation Foundation.

It is another object of the present invention to provide a food preparation table with a cool air supply system capable of efficiently distributing forced air to cool the foodstuffs in the condiment pans without producing unacceptable temperature gradients within the condiment pans.

It is still another object of the present invention to provide a food preparation table with a cool air supply system capable of efficiently distributing forced air from a localized site where the air can be efficiently cooled, to widely dispersed locations, some of which being inside the food storage compartment and some of which being exposed to the ambient atmosphere.

It is yet another object of the present invention to provide a food preparation table with a return air system capable of efficiently collecting relatively warmed air from widely dispersed locations, some of which being inside the food storage compartment and some of which being exposed to the ambient atmosphere, and returning this relatively warmed air to a localized site where the air can be efficiently recooled.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, the food preparation table of the present invention includes a cabinet that defines a food preparation surface extending generally along the length of the cabinet and disposed generally horizontally. The cabinet also defines at least one heat-insulated food storage compartment disposed generally beneath the food preparation surface and defining a door for gaining access inside of the food storage compartment. The food preparation table of the present invention further desirably includes heat-absorbing refrigeration equipment disposed inside the cabinet and including at least one evaporator and an evaporator fan disposed so that air moves through the evaporator upon operation of the fan. Instead of operating continuously, greater efficiency is achieved in some embodiments by having the evaporator fan operate only when the temperature controller activates the cooling cycle of the refrigeration equipment.

The cabinet also defines a condiment plenum disposed adjacent to one elongated side edge of the food preparation surface. The condiment plenum desirably includes at least one condiment plenum wall that defines a complex structure including at least one air channel and at least one upper louver. Desirably, each complex structure of the condiment plenum wall includes at least one lower louver in one preferred embodiment. In an alternative embodiment, separate air channels may be provided for the upper louver and the lower louver. Moreover, in another preferred embodiment, a second condiment plenum wall is spaced apart from the first condiment plenum wall and is similarly configured as the first condiment plenum wall in terms of the complex structure including the air channel and the louver or louvers.

The apparatus of the present invention further includes at least one and desirably a plurality of open top condiment pans that are received by the condiment plenum. Each upper louver is configured and disposed to face toward the condiment plenum and the condiment pans received therein. Each upper louver desirably is disposed above the open top of the condiment pan. Each lower louver, if any, is disposed to provide air flow beneath and outside the open top of the condiment pan.

The food preparation table of the present invention desirably includes a cabinet that defines a cool air supply system. The cool air supply system desirably includes the upper louvers, an air channel communicating with the upper louvers, and a cooling plenum configured and disposed to receive air passing through the evaporator upon operation of the at least one evaporator fan. The food preparation table of the present invention further desirably includes an elongated cool air supply duct, and at least one supply opening that is configured and disposed to connect the elongated cool air supply duct with the food storage compartment. Upon operation of the at least one evaporator fan, the cooling plenum, the elongated cool air supply duct, the upper louvers, the air channel, and the at least one supply opening are configured and disposed to supply from the evaporator, cool air across the tops of the condiment pans and cool air into the food storage compartment.

An elongated air flow baffle can be disposed along the length of the elongated cool air supply duct or the air supply channel to facilitate cool air distribution along the length of same. In one preferred embodiment, a second elongated air flow baffle is disposed along the length of the elongated cool air supply duct and parallel to to the first baffle. In addition, a plurality of air flow dams are disposed transversely to the length of the elongated cool air supply duct and between the two baffles to further assist in ensuring an even distribution of cool air flow into all sections of the condiment plenum to avoid unacceptacle temperature gradients in the condiment pans. Depending on the length of the elongated cool air supply duct, one or more elongated air flow guides is disposed generally at a small angle from being parallel to the length of the elongated cool air supply duct. Each air flow guide is disposed to extend from a site where an air flow dam joins with the first baffle and deviates from a direction parallel to the baffle by only a small angle of about less than five degrees. Furthermore, the condiment plenum wall which receives cool air via the elongated cool air duct, can be provided with vertically disposed air flow dams that are spaced apart down the length of the cabinet and terminate before reaching the height of the upper louver. Each vertical dam is disposed at the site of a transverse air flow dam and assists in ensuring an even distribution of cool air flow into all sections of the condiment plenum.

The food preparation table of the present invention further includes a return air system. The return air system desirably includes a return chamber, a return wall, and at least one return opening. The return wall desirably is disposed between the food storage compartment and the return chamber. The return wall defines at least one return opening that permits access between the food storage compartment and the return chamber. The return chamber and the at least one return opening are desirably configured and disposed to return to the evaporator upon operation of the evaporator fan, relatively warmed air from the food storage compartment. The return air system also returns relatively warmed air from the condiment plenum to the evaporator upon operation of the evaporator fan.

The accompanying drawings, which are incorporated in and constitute a part of this specification, illustrate one embodiment of the invention and, together with the description, serve to explain the principles of the invention.

BRIEF DESCRIPTION OF THE DRAWINGS

In the drawings, the same numbers are applied to the same features in the same or different embodiments.

DETAILED DESCRIPTION OF THE PREFERRED EMBODIMENTS

Reference now will be made in detail to the present preferred embodiments of the present invention, one or more examples of which are illustrated in the accompanying drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover the modifications and variations of this invention provided they come within the scope of the appended claims and their equivalents.

Figure 1:
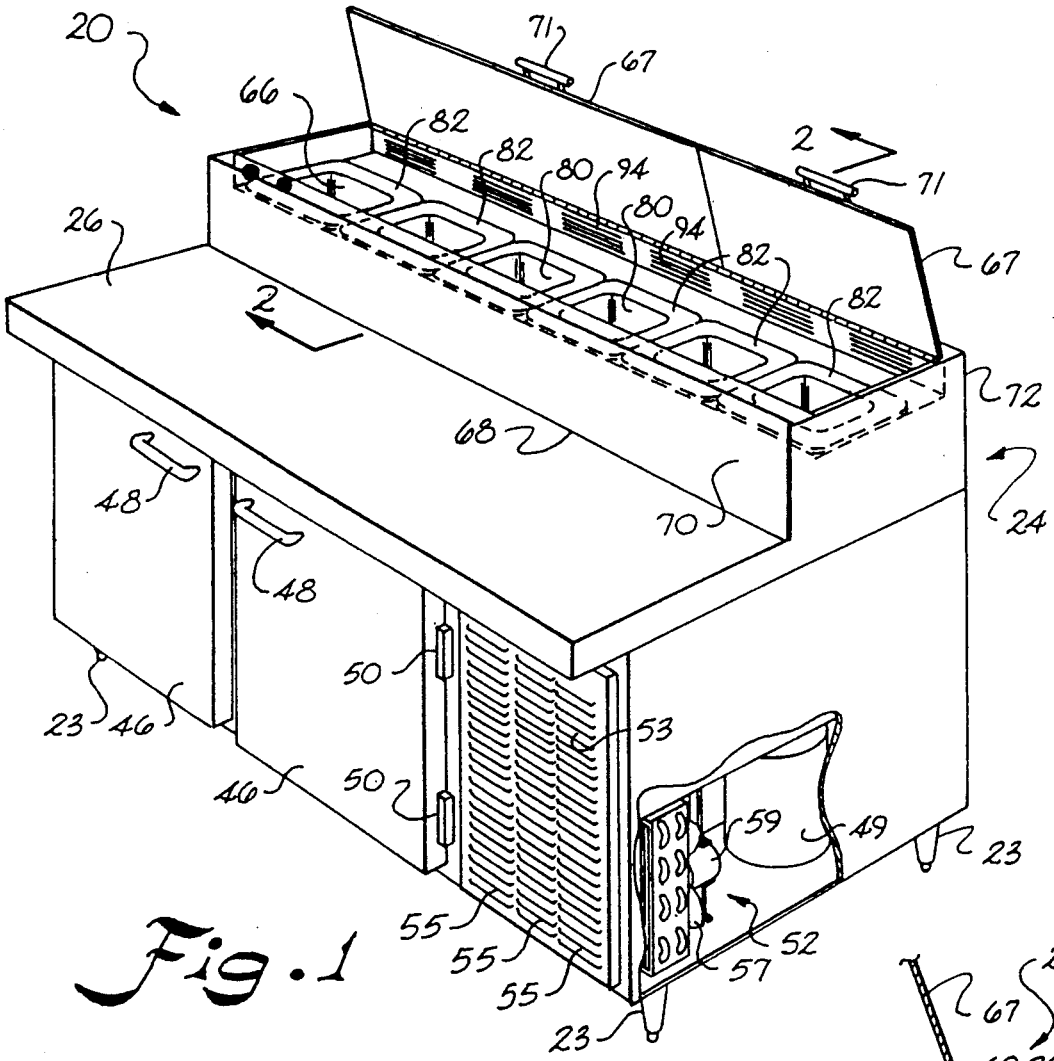
FIG. 1 schematically illustrates an elevated perspective view of a preferred embodiment of the present invention with portions shown in phantom.
Figure 2:
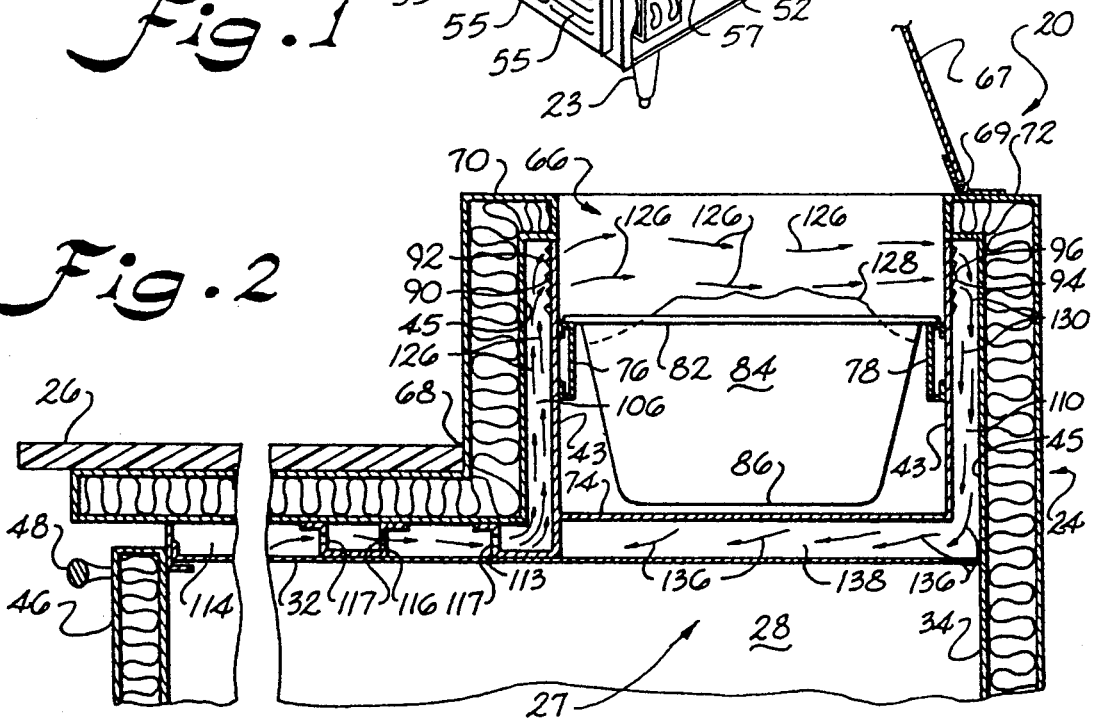
FIG. 2 schematically illustrates a cross-sectional view of a portion of a first preferred embodiment of the air flow passages for the embodiment of the food preparation table of FIG. 1 taken from a perspective looking in the direction indicated by arrows 2—2 and indicating the direction of air flow by the short arrows.
Figure 2A:
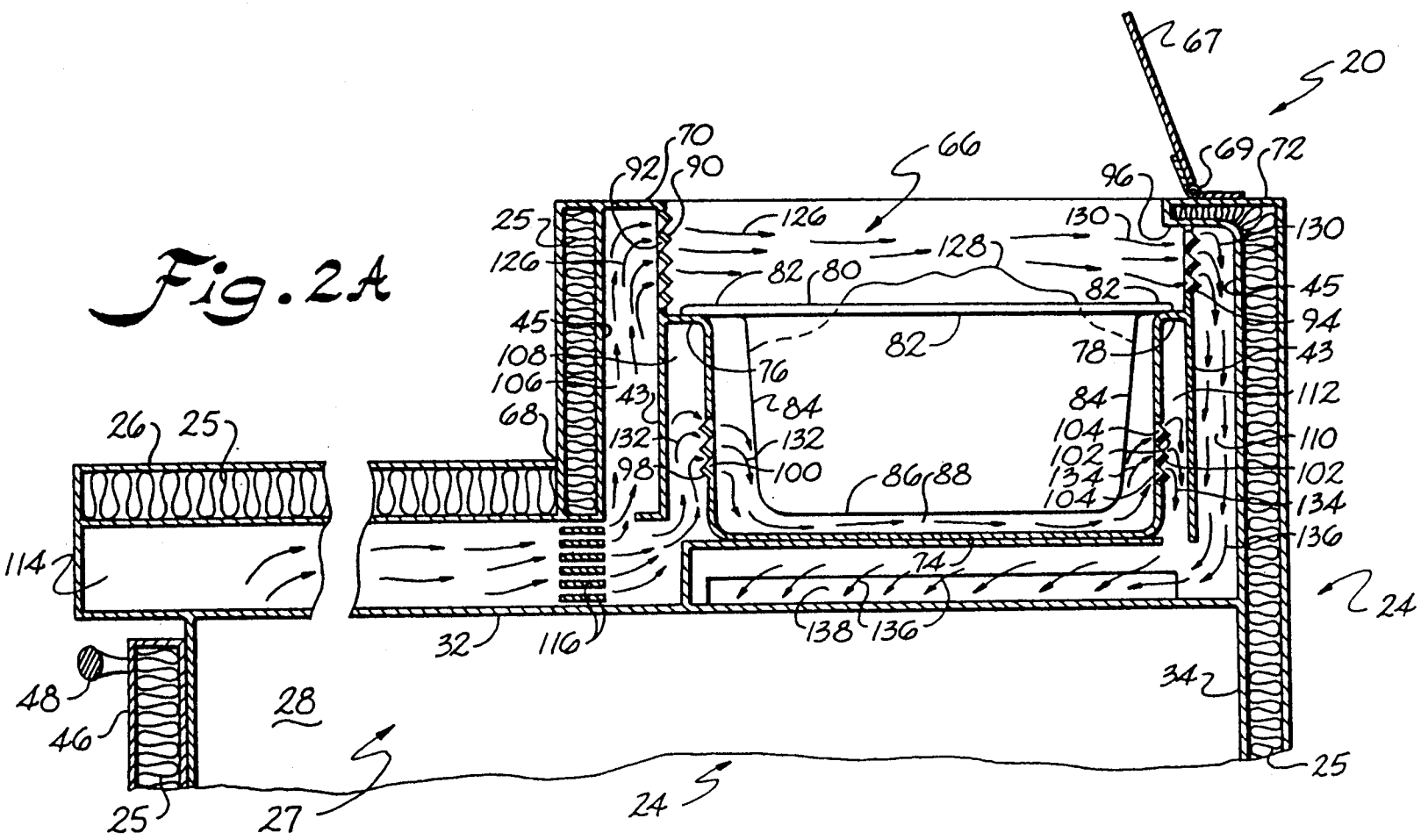
FIG. 2A schematically illustrates a cross-sectional view of a portion of an alternative embodiment of the air flow passages for the embodiment of the food preparation table of FIG. 1 taken from a perspective looking in the direction indicated by arrows 2—2 and indicating the direction of air flow by the short arrows.
Figure 3:
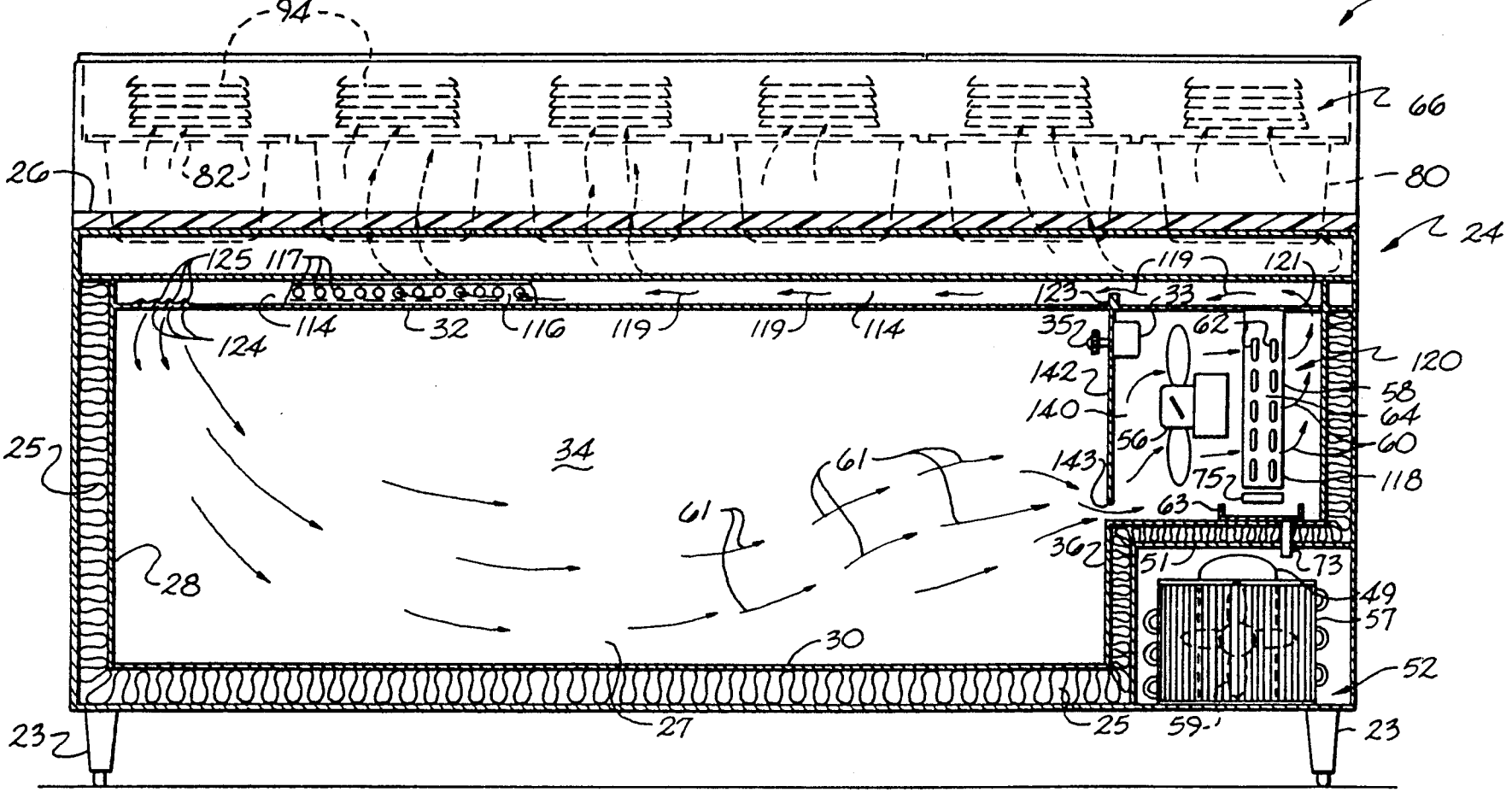
FIG. 3 schematically illustrates a front plan view of a cut-away of a preferred embodiment of the present invention such as shown in FIGS. 1 and 2.
Figure 4:
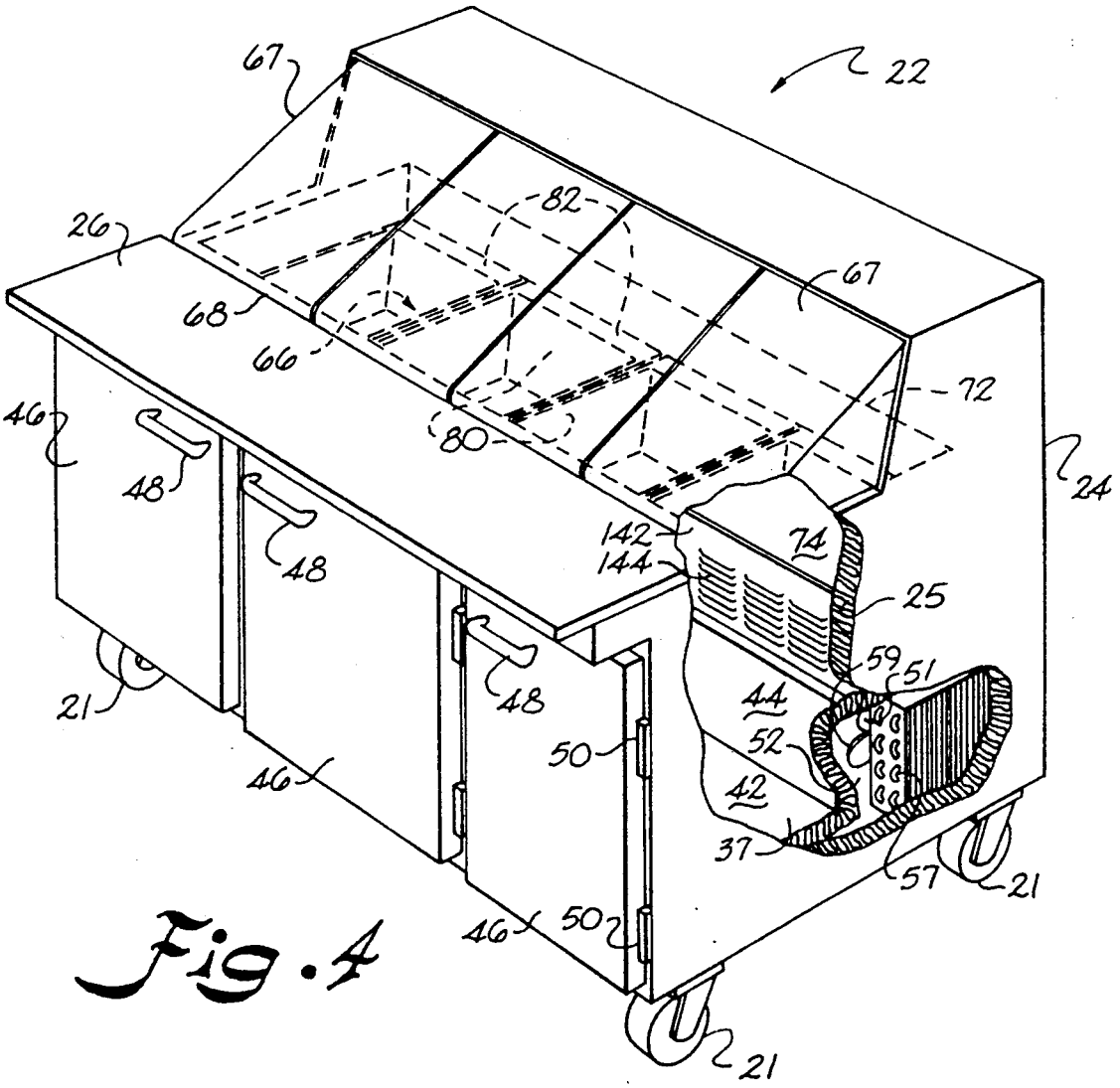
FIG. 4 schematically illustrates an elevated perspective view of a second preferred embodiment of the present invention with portions cut away and portions shown in phantom (dashed lines)
Figure 5:
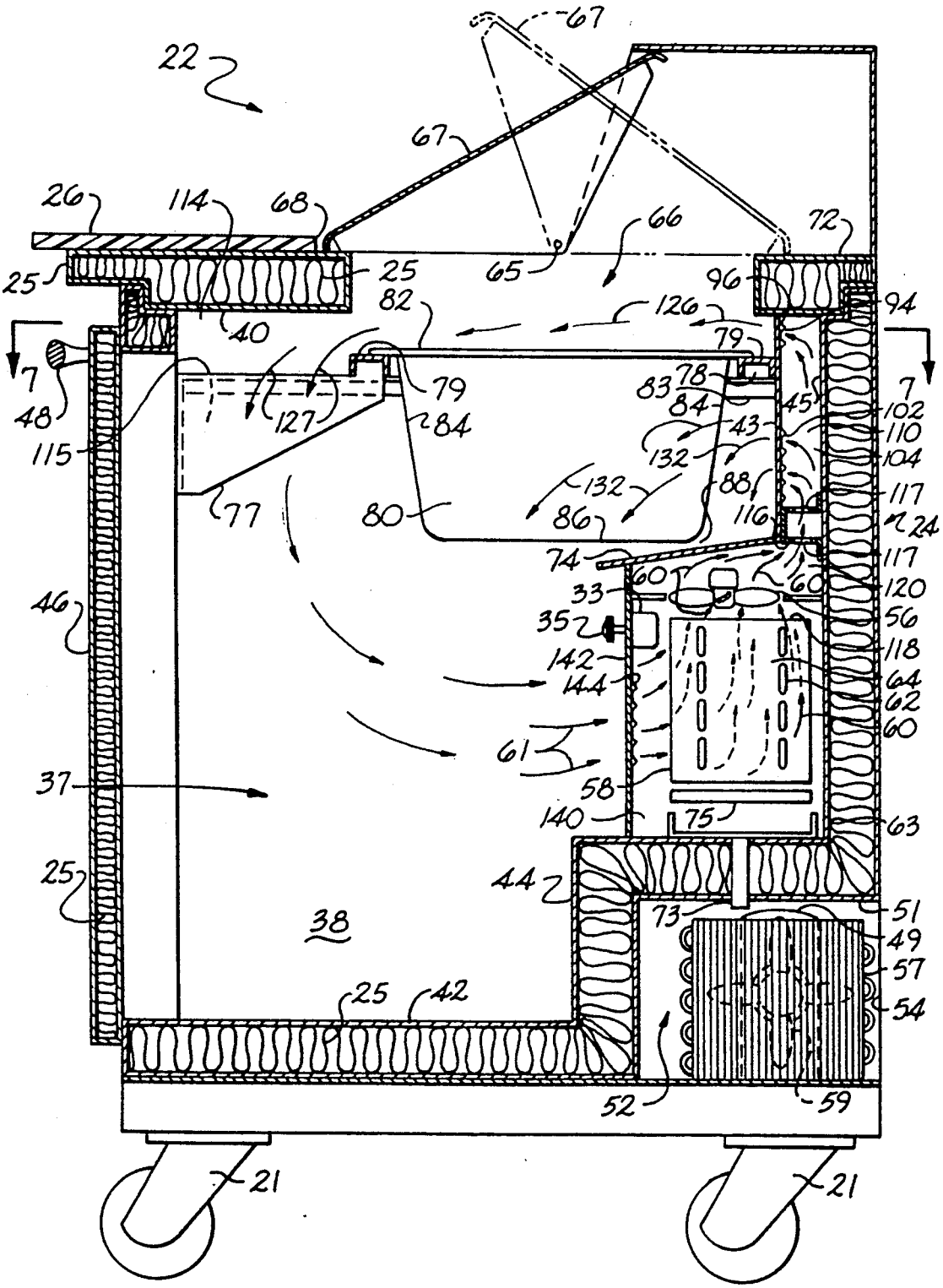
FIG. 5 schematically illustrates a cut-away side plan view of the preferred embodiment of the present invention such as shown in FIG. 4.

A preferred embodiment of the food preparation table of the present invention is shown in FIGS. 1, 2, 3 and 6, and is represented generally by the numeral 20. Table 20 is especially useful for preparing pizza. An alternative preferred embodiment of the food preparation table of the present invention is shown in FIGS. 4, 5 and 7 and is represented generally by the numeral 22. Table 22 is especially useful for preparing sandwiches. Another alternative embodiment which is generally designated by the numeral 20 and shown in FIGS. 1, 2A and 3, is also especially useful for preparing pizza.

In accordance with the present invention, a cabinet is provided. The cabinet defines a food preparation surface, which is an exterior top surface of the cabinet or a separate cutting surface carried by the exterior top surface of the cabinet and extends generally along the length of the cabinet. The food preparation surface is disposed generally horizontally at a height that is convenient for the person who prepares the food on the food preparation surface. As embodied herein and shown in FIGS. 1–6 for example, a cabinet is generally designated by the numeral 24. As shown in FIGS. 1, 3, 4 and 5 for example, cabinet 24 is carried above the floor by a plurality of legs 23 (FIGS. 1 and 3) or casters 21 (FIGS. 4 and 5).

As shown in FIGS. 1, 2, 4, 5, 5A, 5B and 6 for example, a food preparation surface in the form of a countertop 26 desirably forms an exterior top surface of cabinet 24. Countertop 26 extends generally along the length of cabinet 24 and is disposed generally horizontally at a height convenient for persons who prepare food on countertop 26. As shown in FIGS. 1, 2, 4, 5 and 6 for example, cabinet 24 desirably is formed of stainless steel and countertop 26 desirably is formed of a surface such as wood or plastic that functions as a cutting board and easily can be kept clean enough for food preparation. In the embodiment of FIG. 2A, cabinet 24 and countertop 26 are both desirably formed of stainless steel. As shown schematically in FIGS. 2, 2A 5A, 5B and 6 for example, insulation 25 (represented by sinsudoidal wavy lines) is disposed beneath countertop 26.

In further accordance with the present invention, the cabinet defines at least one heat insulated, food storage compartment disposed beneath the food preparation surface. The cabinet includes at least one door which permits access to the inside of the food storage compartment. As embodied herein and shown in one or more of FIGS. 2, 2A, and 3 for example, a heat insulated food storage compartment 27 desirably is defined by an end-wall 28, a bottom wall 30, a ceiling wall 32, a rear wall 34, and a separation wall 36 (FIG. 3). As shown schematically in FIG. 3 for example, heat insulation 25 generally is disposed between the walls defining food storage compartment 27 and the walls defining cabinet 24.

Figure 5A:
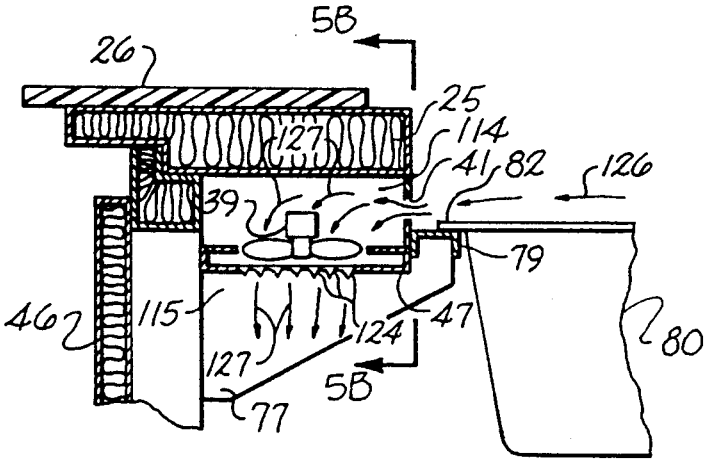
FIG. 5A schematically illustrates a side plan view of an alternative embodiment of a portion of a preferred embodiment of the present invention such as shown in FIGS. 4, 5 and 7.
Figure 5B:
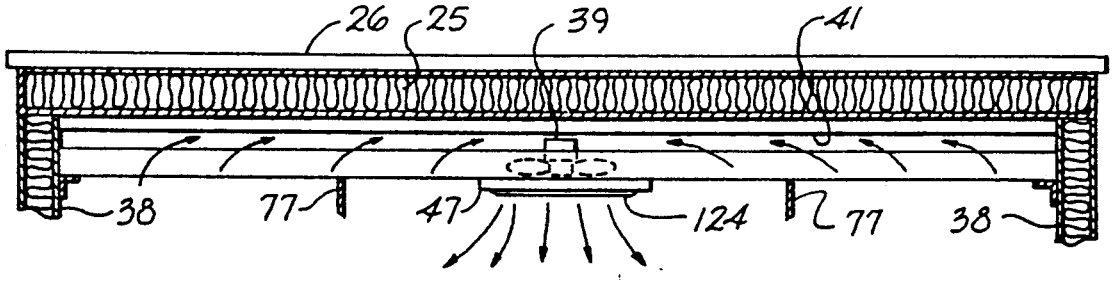
FIG. 5B schematically illustrates a front plan view of the alternative embodiment shown in FIG. 5A taken from a perspective looking in the direction indicated by arrows 5B—5B in FIG. 5A and with the short arrows indicating the direction of air flow.

As embodied herein and shown in one or more of FIGS. 4 5 and 5B for example, a food storage compartment 37 is defined by a pair of end walls 38, a top wall 40 (FIG. 5) disposed beneath countertop 26, a bottom wall 42, and a separation wall 44. As schematically shown in FIG. 4, heat insulation 25 desirably is provided between the walls defining food storage compartment 37 and the exterior walls of cabinet 24.

As shown in FIGS. 1, 2, 2A, 4 and 5 for example, cabinet 24 defines at least one door 46 for gaining access inside food storage compartment 27 or 37. Desirably, as shown in FIGS. 1 and 4 for example, more than one door 46 can be provided, and each door 46 has a handle 48 and hinges 50 by which each door 46 can be opened for gaining access inside food storage compartment 27 or 37. As schematically shown in FIGS. 2, 2A, and 5 for example, each door 46 is provided with heat insulation 25.

In further accordance with the present invention, the cabinet defines a heat insulated housing for the heat-generating refrigeration equipment. As embodied herein and shown in FIGS. 1, 3, 4 and 5 for example, a housing is indicated generally by the numeral 52 and is disposed within cabinet 24. Separation wall 36 (FIG. 3) or 44 (FIGS. 4 and 5) is heat insulated from housing 52 and separates housing 52 from food storage compartment 27 (FIG. 3) or 37 (FIGS. 4 and 5). As shown in FIG. 3 for example, housing 52 defines a top wall 51, which is heat insulated from food storage compartment 27 and from a cooling plenum 120 (described hereafter). As shown in FIG. 5 for example, housing 52 defines a top wall 51, which is heat insulated from food storage compartment 37. As shown in FIGS. 4 and 5 for example, housing 52 is disposed between separation wall 44 and the rear exterior wall 54 (FIG. 5) of cabinet 24. The heat-generating refrigeration equipment disposed inside housing 52 includes a condenser 57, a compressor 49 (not shown in FIG. 4 and largely obscured in FIG. 5) which compresses the coolant supplied to an evaporator (described below), and a condenser fan 59 (shown in phantom in FIGS. 3 and 5 by the dashed lines).

Figure 6:
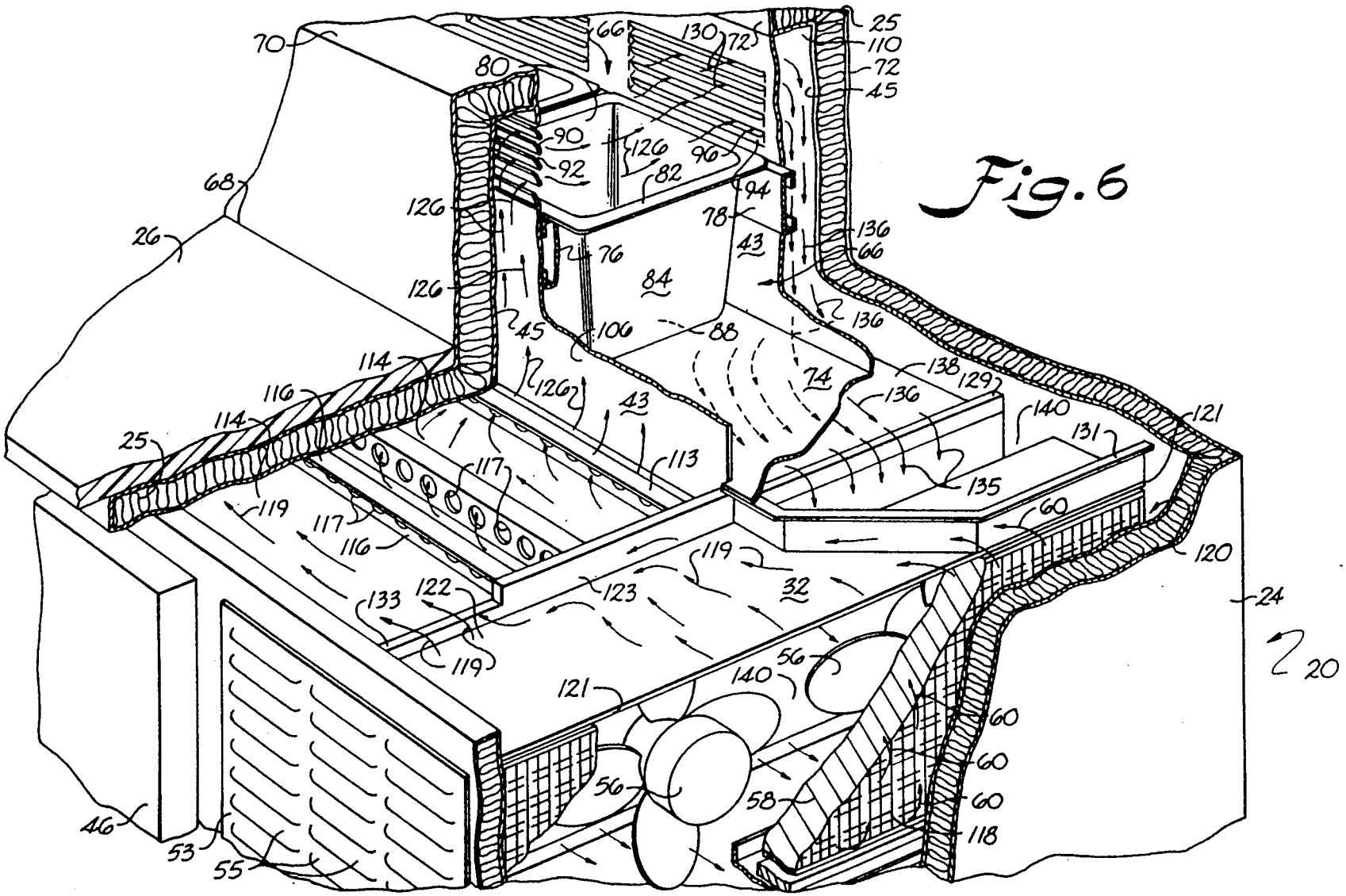
FIG. 6 schematically illustrates an elevated perspective view of a cut-away of the preferred embodiment of the present invention such as shown in FIGS. 1 and 2 with portions cut away and with the short arrows indicating the direction of air flow.
Figure 7:
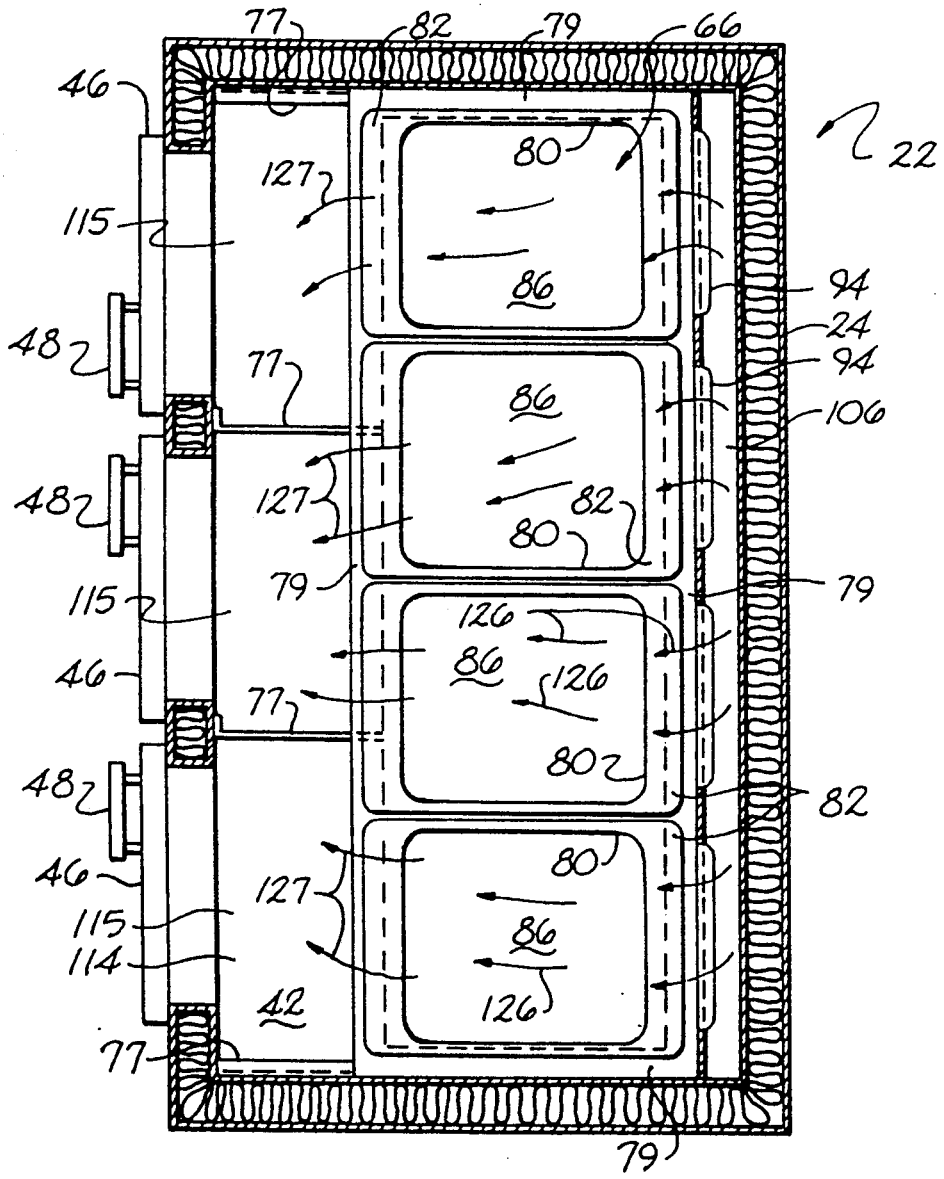
FIG. 7 schematically illustrates a top plan view of a portion of the second preferred embodiment of the food preparation table of FIGS. 4 and 5 taken from a perspective looking in the direction indicated by arrows 7—7 in FIG. 5 and with the short arrows indicating the direction of air flow.

As shown in FIGS. 1 and 6 for example, housing 52 can be further defined by a removable access panel 53, which permits access to the interior of housing 52 for servicing the heat-generating refrigeration equipment from the front of cabinet 24. Panel 53 desirably includes a plurality of air circulation louvers 55 which permit ambient air to enter housing 52 and heated air to escape from housing 52 and enter the surrounding environment.

In yet further accordance with the present invention, the heat-absorbing refrigeration equipment is disposed in communication with a cooling plenum, which receives cooled air for distribution to the food storage compartment and elsewhere as described hereafter. The heat-absorbing refrigeration equipment disposed in communication with the cooling plenum includes at least one fan and an evaporator, which are disposed so that air moved by operation of the fan also moves through the evaporator and becomes cooled before entering the cooling plenum. The space defined by the cooling plenum is indicated generally in FIGS. 3, 5 and 6 by the numeral 120. As embodied herein and schematically shown in FIGS. 3, 5 and 6 for example, an evaporator 58 has a discharge face 118 which is disposed to define one boundary of cooling plenum 120, and at least one fan 56 is disposed to move air through evaporator 58 upon operation of fan 56. Two fans 56 are shown at least partially in FIG. 6, but only one is visible in the views schematically shown in FIGS. 3 and 5. As schematically shown by arrows designated 60 in FIGS. 3, 5 and 6 for example, fan 56 moves air through evaporator 58 and into cooling plenum 120.

Evaporator 58 desirably is a finned tube evaporator that carries refrigerant circulating through a plurality of tubes 62 extending transversley through a plurality of fins 64 disposed side-by-side. Only the end-most fin 64 is visible in the view depicted in FIG. 3. As shown schematically in FIGS. 3 and 5 for example, a condensate pan 63 is disposed beneath evaporator 58. As schematically shown in FIG. 3 for example, an electric coil defrost heater 75 desirably is disposed between evaporator 58 and condensate pan 63 to remove frost from the evaporator. A defrost heater 75 is also schematically shown in FIG. 5, but desirably is omitted from the FIG. 5 embodiment. As a result of the advantageous relative location of the various components of the refrigeration equipment, as schematically shown in FIGS. 3 and 5, a drain tube 73 connects pan 63 to housing 52 to allow condensate to drain from pan 63 into housing 52.

In accordance with some embodiments of the present invention, rather than running continuously, the evaporator fan is operated intermittently under the control of a temperature controller that also controls operation of the refrigeration equipment in the cooling mode. As embodied herein and shown schematically in FIGS. 3 and 5 for example, a temperature controller 33 is mounted behind a wall 142 which defines the food storage compartment 27 or 37. Controller 33 is electrically connected to control operation of evaporator fan 56 as well as compressor 49 and contains a thermostat which senses temperature. The temperature to be sensed can be preselected via a control knob 35 which extends into the respective food storage compartment 27 or 37 and forms a part of temperature controller 33. Upon detection of a temperature higher than has been set by control knob 35, temperature controller 33 operates the refrigeration equipment (compressor 49) in the cooling mode. In an embodiment such as shown schematically in FIGS. 3 and 6 for example, temperature controller 33 desirably is configured and connected electrically to cause evaporator fan 56 to operate only during such time as the refrigeration equipment is being operated in the cooling mode. This intermittent operating control sequence for the evaporator fan limits operation of the fan to such times as the compressor is operating in the cooling mode of the refrigeration equipment and yields a more efficient operation of the refrigeration equipment in such embodiments. In an embodiment such as shown schematically in FIG. 5 for example, evaporator fan 56 desirably is configured and connected electrically to operate continuously, even during such time as the refrigeration equipment is not being operated by temperature controller in the cooling mode.

In still further accordance with the present invention, the cabinet defines a condiment plenum that is disposed adjacent to one of the elongated side edges of the food preparation surface. In one embodiment of the present invention (FIGS. 1-3 and 6), the condiment plenum is further defined by a front wall that is disposed adjacent to the one side edge of the food preparation surface. In another embodiment of the present invention (FIGS. 4, 5 and 7), the condiment plenum is formed as part of the refrigerated food storage compartment but is still disposed adjacent to the one side edge of the food preparation surface. The condiment plenum further is defined by a rear wall that either is spaced away from and opposite to the front wall (FIGS. 1-3 and 6) or to the rear of the refrigerated food storage compartment (FIGS. 4, 5 and 7). In addition, the plenum defines a bottom wall that extends from the rear wall. The condiment plenum is configured to receive a plurality of open top condiment pans, which hold foodstuffs used by the food preparer to assemble food servings on the food preparation surface.

As embodied herein and shown in FIGS. 1-5, 6 and 7 for example, a condiment plenum is indicated generally by the numeral 66. As shown in FIGS. 1, 2, 2A, 4, 5 and 6 for example, condiment plenum 66 is disposed adjacent an elongated side edge 68 of the food preparation surface. As shown in the embodiment of FIGS. 1, 2, 2A and 6 for example, plenum 66 can include a front condiment plenum wall 70 disposed adjacent side edge 68 of countertop 26. A rear condiment plenum wall 72 can be spaced apart from front condiment plenum wall 70. As shown schematically in FIGS. 2, 2A and 6 for example, condiment plenum 66 further defines a bottom condiment plenum wall 74 which extends from rear plenum wall 72 and between front plenum wall 70 and rear plenum wall 72 to connect same. In the embodiment shown in FIG. 5 for example, condiment plenum 66 is defined in part by a rear plenum wall 72 from which a bottom plenum wall 74 extends toward refrigerated food storage compartment 37.

As shown in FIGS. 1, 2, 2A, 4 and 5 for example, plenum 66 can be provided with one or more covers 67 which are pivotally mounted to selectively limit access to plenum 66. As shown in FIGS. 1, 2, and 2A for example, each cover 67 can be pivotally mounted to the top of rear plenum wall 72 via hinges 69 (FIGS. 2, 2A). Alternatively, as shown in FIG. 5 for example, each cover 67 can be pivotally mounted to the top of the cabinet 24 wherein cover 67 is in the form of a triangular hood that is pivotally mounted at 65 so that the weight of cover 67 is balanced to maintain cover 67 in a stable position at each opposite extreme position of pivotal movement. One extreme position (dashed line in FIG. 5) of pivotal movement of cover 67 corresponds to the cover position which allows access to condiment plenum 66, while the opposite extreme position (solid line in FIG. 5) of pivotal movement corresponds to the cover position which prevents access to condiment plenum 66. As shown in FIG. 1 for example, each cover 67 can be provided with a handle 71 for manually lifting or lowering cover 67.

In addition, means is provided for supporting the condiment pans inside the condiment plenum. As shown in FIGS. 2, 2A and 6 for example, plenum 66 desirably is configured with a front ledge 76 disposed along the length of front plenum wall 70 and a rear ledge 78 disposed along the length of rear plenum wall 72. Moreover, as shown in FIGS. 5, 5A and 7 for example, a removable frame 79 is formed in a rectangular shape and configured to rest at least partly on a pan support member 77. As schematically shown in FIG. 5 for example, a peripheral ledge 83 is disposed along the length of rear plenum wall 72, and frame 79 is configured to rest at least partly on peripheral ledge 83. Desirably, peripheral ledge 83 extends on each side from rear condiment plenum wall 72 and toward pan support members 77. Ledges 76, 78 and 83 are thus configured to receive a plurality of open top condiment pans 80.

As embodied herein and shown in FIGS. 1-5A, 6 and 7 for example, each condiment pan 80 defines a peripheral lip 82 at the top surface thereof. Lip 82 desirably extends completely around pan 80 and rests atop ledges 76, 78 or frame 79 when pan 80 is received inside plenum 66. Each pan 80 is desirably symmetrically configured so that it can be rotated 90° and still fit inside plenum 66. However, elongated condiment pans having two relatively longer side dimensions also can be provided. As schematically shown in FIGS. 2, 2A, 5 and 6 for example, each pan 80 defines side walls 84 extending from top lip 82. As schematically shown in FIGS. 2, 2A, 5 and 7 for example, each pan 80 further defines a pan bottom wall 86. Each condiment pan 80 is configured so that its bottom wall 86 leaves an air space 88 between the pan bottom 86 and condiment plenum bottom wall 74 when pan 80 is disposed in condiment plenum 66.

In yet further accordance with the present invention, the condiment plenum is defined by at least one condiment plenum wall which defines a complex wall structure. Alternatively, the condiment plenum is defined by a pair of spaced apart condiment plenum walls, and each condiment plenum wall defines a complex wall structure. As embodied herein and schematically shown in FIGS. 2, 2A, 5, and 6 for example, each complex condiment plenum wall structure is defined by an interior wall panel 43 which faces the interior of and defines at least a portion of the interior of condiment plenum 66. As embodied herein and schematically shown in FIGS. 2, 2A, 5, and 6 for example, each complex condiment plenum wall structure is defined by an exterior wall panel 45 which is disposed generally parallel to and spaced apart from and opposite to interior wall panel 43. Exterior wall panel 45 faces away from the interior of condiment plenum 66. Moreover, the complex condiment plenum wall structure includes at least one, and desirably a plurality, of upper louvers defined in the upper regions of interior wall panel 43 of at least one of the front and rear condiment plenum walls. Each upper louver is disposed above the open tops of the condiment pans. The upper louvers of one of the condiment plenum walls are configured and disposed to direct airflow in a downward direction toward the condiment pans. In the embodiments of the present invention containing both front and rear condiment plenum walls (FIGS. 2, 2A and 6), the upper louvers of the other of the condiment plenum walls are configured and disposed to receive airflow in an upward direction away from the condiment pans. In the embodiments of the present invention containing both front and rear condiment plenum walls, the upper louvers of the front plenum wall desirably are disposed to face across from the upper louvers of the rear plenum wall.

As embodied herein and shown schematically in FIGS. 2 and 6 for example, a first or front plenum wall 70 defines a plurality of upper louvers 90 defined in the upper region of front wall 70. As shown in FIG. 6, upper louvers 90 of front condiment plenum wall 70 are desirably configured to extend toward and into front wall 70 at about a 45 degree angle in a manner that extends away from plenum 66 and disposes the upper louver opening 92, which is formed as an elongated slit through front condiment plenum wall 70, so that air entering these louver openings 92 from within front condiment plenum wall 70 and moving toward rear plenum wall 72 and pans 80, is guided to travel in a downwardly direction toward pans 80 at about a 45 degree angle from the surface of front condiment plenum wall 70. The downward directional bias of each upper louver 90, as shown schematically in FIGS. 2 and 6 for example, prevents foodstuff which happens to enter openings 92, from getting past upper louvers 90 of front plenum wall 70 and falling inside the complex wall structure of front plenum wall 70, and thus contributes to the sanitary condition of the food preparation table of the present invention. In other words, in order to enter the complex wall structure of front wall 70, the foodstuff would need to travel against the force of gravity far enough in an upward direction to get past the free edge of louver 90.

As alternatively embodied herein and shown schematically in FIG. 2A for example, front plenum wall 70 defines a plurality of upper louvers 90 defined in the upper region of front wall 70. Upper louvers 90 of front plenum wall 70 are desirably configured to extend away from front wall 70 at about a 45 degree angle in a manner that extends toward plenum 66 and hoods or shields the upper louver opening 92, which is formed in front wall 70 beneath where each corresponding upper louver 90 remains attached to front wall 70, so that air exiting these upper louver openings 92 from within front wall 70 and moving toward plenum 66 and pans 80, travels in a downwardly direction toward pans 80 at about a 45 degree angle from the surface of front plenum wall 70. As shown schematically in FIG. 2A for example, the downward directional bias of the front wall's upper louvers 90, prevents foodstuff which falls from above from entering upper louver openings 92 of upper louvers 90, and thus contributes to the sanitary condition of the food preparation table of the present invention.

As schematically shown in FIGS. 1–3, 5 and 6 for example, rear condiment plenum wall 72 also defines a plurality of upper louvers 94 in the upper region of rear wall 72. Upper louvers 94 of rear plenum wall 72 are desirably configured to extend away from rear wall 72 at about a 45 degree angle in a manner that extends away from plenum 66 and disposes the upper louver opening 96, which is formed as an elongated slit in rear wall 72, so that air entering these louver openings 96 from within condiment plenum 66 and moving toward rear plenum wall 72 and away from pans 80, travels in an upwardly direction away from pans 80 at about a 45 degree angle from the surface of rear plenum wall 72. The upward directional bias of each upper louver 94, as shown schematically in FIGS. 2, 2A, 5 and 6 for example, prevents foodstuff which happens to enter upper louver openings 96, from getting past upper louvers 94 of rear plenum wall 72 and falling inside the complex wall structure of rear plenum wall 72, and thus contributes to the sanitary condition of the food preparation table of the present invention. Alternatively, upper louvers 94 of rear wall 72 could be configured and disposed so that the upper louver opening 96 is formed below where each upper louver 94 remains attached to rear condiment plenum wall 72 and louvers 94 would extend downwardly toward plenum 66 in a manner similar to the configuration of upper louvers 90 shown in FIG. 2.

As shown schematically in FIGS. 2, 2A, 5 and 6 for example, upper louvers 90, 94 are configured and disposed above the open tops of condiment pans 80. Upper louvers 90 of front condiment plenum wall 70 face toward condiment pans 80, while upper louvers 94 of rear condiment plenum wall 72 face away from condiment pans 80. Moreover, in the embodiments of FIGS. 2, 2A and 6 for example, upper louvers 90 of front wall 70 face across from upper louvers 94 of rear wall 72, which is important for controlling the direction of cool air flow, as explained hereafter.

In a first preferred embodiment of the present invention shown in FIGS. 2 and 6 for example, the complex wall structure of each of the front and rear condiment plenum walls includes an air channel extending along the length of each of the respective front and rear walls.

Each air channel is configured to communicate with the upper louvers of the respective condiment plenum wall. As embodied herein and schematically shown in FIGS. 2 and 6 for example, front plenum wall 70 defines a complex structure including an upper supply channel 106 defined between interior wall panel 43 and exterior wall panel 45. Upper supply channel 106 is configured and disposed in communication with upper louver openings 92 in front plenum wall 70. Similarly, rear condiment plenum wall 72 defines a complex structure including an upper return channel 110, which is configured and disposed in communication with upper louver openings 96 of rear plenum wall 72 and is defined between interior wall panel 43 and exterior wall panel 45.

In an alternative embodiment schematically shown in FIG. 2A for example, the complex wall structure of each of the front and rear condiment plenum walls includes a plurality of lower louvers defined in the lower regions of the front and rear walls. Lower louvers also could be provided in the embodiment shown in FIG. 2 for example. The lower louvers in one of the plenum walls are configured and disposed to direct airflow in a downward direction toward the condiment pans, while the lower louvers in the other of the plenum walls are configured and disposed to direct airflow in an upward direction away from the condiment pans. In addition, the lower louvers are disposed below the open tops of the condiment pans. The lower louvers of the front wall desirably are disposed to face across from the lower louvers of the rear wall.

As embodied herein and shown schematically in FIG. 2A for example, front plenum wall 70 defines a plurality of lower louvers 98 defined in the lower region of front plenum wall 70. Lower louvers 98 of front plenum wall 70 are desirably configured to extend away from front wall at about a 45 degree angle in a manner that extends away from plenum 66 and disposes the lower louver opening 100 formed in the lower portion of front wall 70 above where each lower louver 98 remains attached to front wall 70, so that air entering these lower louver openings 100 from within front wall 70 and moving toward plenum 66 and pans 80, travels in an downwardly direction away from front plenum wall 70 and toward pans 80 at about a 45 degree angle from the surface of front plenum wall 70. The downward directional bias of each lower louver 98, as shown schematically in FIG. 2A for example, directs air to air space 88 beneath pans 80 and toward rear plenum wall 72. Thus, lower louvers 98 of front wall 70 alternatively could be configured and disposed so that the lower louver opening 100 is formed in the lower portion of front wall 70 below where each lower louver 98 remains attached to front wall 70.

As schematically shown in this embodiment of FIG. 2A for example, rear plenum wall 72 also defines a plurality of lower louvers 102 in the lower region of rear wall 72. Lower louvers 102 of rear plenum wall 72 are desirably configured to extend away from rear wall 72 at about a 45 degree angle in a manner that extends away from plenum 66 and disposes the lower louver opening 104 formed in rear wall 72 above where each lower louver 102 remains attached to rear wall 72. In this configuration, air entering these lower louver openings 104 from within plenum 66 and moving toward rear plenum wall 72 and away from pans 80, travels in an upwardly direction away from pans 80 at about a 45 degree angle from the surface of rear plenum wall 72. The upward directional bias of each lower louver 102, as shown schematically in FIG. 2A for example, corresponds to the direction of relatively warmed air rising within rear plenum wall 72, and thus facilitates the exodus of the relatively warm return air from beneath pans 80 of the food preparation table of the present invention. Alternatively, lower louvers 102 of rear wall 72 could be configured and disposed so that the lower louver opening 104 is formed in the lower portion of rear wall 72 below where each lower louver 102 remains attached to rear condiment plenum wall 72.

As shown schematically in FIG. 2A for example, lower louvers 98, 102 are configured and disposed below open tops of condiment pans 80 and are disposed in a direction away from pans 80. The upward directional bias of each lower louver 98, 102, prevents foodstuff from getting past either front condiment plenum wall 70 or rear condiment plenum wall 72 through respective lower louver openings 100, 104 of lower louvers 98, 102, and thus contributes to the sanitary condition of the food preparation table of the present invention. As shown schematically in FIG. 2A for example, lower louver openings 100 of front plenum wall 70 face across from lower louver openings 104 of rear plenum wall 72, which is important for controlling the direction of cool air flow in this embodiment of the invention, as explained hereafter. As further embodied herein and schematically shown in FIG. 2A for example, lower louver openings 100, 104 desirably are disposed in communication with the air space 88 disposed between plenum bottom wall 74 and bottoms 86 of condiment pans 80.

In accordance with the FIG. 2A embodiment of the present invention, each of the complex wall structures of the front and rear condiment plenum walls defines a pair of air channels extending along the lengths of each of the front and rear walls. One of the pair of air channels is configured to communicate with the upper louvers of the wall. The other of the pair of air channels is configured to communicate with the lower louvers of the condiment plenum wall. Alternatively, each front and rear condiment plenum wall structure can define only a single air channel (as in FIGS. 2 and 6 for example), rather than two channels separated from one another as shown in the FIG. 2A. embodiment. One way to accomplish this alternative configuration would be to eliminate the lower section of the middle separating panel, i.e., interior wall panel 43, that is shown inside the condiment plenum wall which is depicted in FIG. 2A for example.

As embodied herein and schematically shown in the embodiment of FIG. 2A for example, front plenum wall 70 defines a complex structure including an upper supply channel 106 and a lower supply channel 108. Upper supply channel 106 is configured and disposed in communication with upper louver openings 92, and lower supply channel 108 is configured and disposed in communication with lower louver openings 100 in front plenum wall 70. As embodied herein and schematically shown in FIG. 2A for example, rear plenum wall 72 defines a complex structure including an upper return channel 110 and a lower return channel 112. Upper return channel 110 is configured and disposed in communication with upper louver openings 96 of rear plenum wall 72, and lower return channel 112 is configured and disposed in communication with lower louver openings 104 of rear plenum wall 72.

In a second preferred embodiment schematically shown in FIGS. 4 and 5 for example, the complex wall structure of the rear condiment plenum wall includes a plurality of lower louvers defined in the lower regions of the rear condiment plenum wall. The lower louvers in the rear condiment plenum wall are configured and disposed to direct airflow in a downward direction toward the condiment pans. In addition, the lower louvers are disposed below the open tops of the condiment pans.

As embodied herein and shown schematically in FIG. 5 for example, rear condiment plenum wall 72 defines a plurality of lower louvers 102 defined in the lower region of interior wall panel 43 of rear plenum wall 72. Lower louvers 102 of rear plenum wall 72 are desirably configured to extend away from rear wall 72 at about a 45 degree angle in a manner that extends away from plenum 66 and disposes the lower louver opening 104 formed in the lower portion of rear wall 72 above where each lower louver 102 remains attached to rear wall 72, so that air entering these lower louver openings 104 from within rear wall 72 and moving toward plenum 66 and pans 80, is guided to travel in an downwardly direction away from rear plenum wall 72 and toward pans 80 at about a 45 degree angle from the surface plane of interior wall panel 43 of rear plenum wall 72. The downward directional bias of each lower louver 102, as shown schematically in FIG. 5 for example, directs air to air space 88 beneath pans 80 and toward food storage compartment 37. Alternatively, lower louvers 102 of rear wall 72 could be configured and disposed so that the lower louver opening 104 is formed in the lower portion of rear wall 72 below where each lower louver 102 remains attached to rear wall 72.

As shown schematically in FIG. 5 for example, lower louvers 102 are configured and disposed below open tops of condiment pans 80 and are disposed in a direction away from pans 80. The upward directional bias of each lower louver 102, prevents foodstuff from getting inside rear condiment plenum wall 72 through respective lower louver openings 104 of lower louvers 102, and thus contributes to the sanitary condition of the food preparation table of the present invention. As further embodied herein and schematically shown in FIG. 5 for example, lower louver openings 104 desirably are disposed in communication with the air space 88 disposed between condiment plenum bottom wall 74 and bottoms 86 of condiment pans 80.

In accordance with the preferred embodiment of the present invention schematically illustrated in FIGS. 4 and 5, the complex wall structure of the rear condiment plenum wall defines an air channel extending along the length of the rear condiment plenum wall and configured to communicate with both the upper louvers and lower louvers of the wall. As embodied herein and schematically shown in FIG. 5 for example, rear condiment plenum wall 72 defines a complex structure including an upper supply channel 110 which is defined between interior wall panel 43 and exterior wall panel 45. Upper supply channel is desirably configured and disposed in communication with upper louver openings 96 and lower louver openings 104 in rear condiment plenum wall 72.

In yet further accordance with the present invention, the cabinet further defines a cool air supply system. The cool air supply system carries cool air from the evaporator into the food storage compartment and into the condiment plenum upon operation of at least one fan. The cool air supply system includes an elongated horizontally disposed supply duct configured and disposed in communication with the food storage compartment.

As embodied herein and schematically shown in FIGS. 2 3, 5 and 6 for example, one embodiment of the cool air supply system includes an elongated supply duct 114 which is disposed beneath the food preparation surface defined by countertop 26. Duct 114 is sized to run along the length of the food preparation surface defined by countertop 26 and is at least as wide as about one half the width of the food preparation surface that is farthest from side edge 68 of the food preparation surface. As shown in the first preferred embodiment of FIGS. 2, 3 and 6 for example, elongated cool air supply duct 114 is desirably defined between insulated countertop 26 and ceiling wall 32 of food storage compartment 27 and is configured and disposed in communication with upper supply channel 106 of front condiment plenum wall 70. As shown in the alternative embodiment of FIGS. 2A and 3 for example, elongated cool air supply duct 114 is desirably defined between insulated countertop 26 and ceiling wall 32 of food storage compartment 27 and is configured and disposed in communication with upper supply channel 106 of front condiment plenum wall 70 and lower supply channel 108 of front plenum wall 70.

In a second preferred embodiment shown in FIGS. 5 (side view), 5A (partial view) and 7 (top view) for example, elongated cool air supply duct 114 of the cool air supply system communicates with at least two cool air supply slots 115 (FIG. 7). Each cool air supply slot 115 is defined between each pair of adjacently disposed support members 77 for the condiment pans 80. As shown schematically in the top view of FIG. 7 for example, each slotted opening 115 is so large in relation to the metal thickness of each support member 77, that the flow of cool air is largely unimpeded by any structure as it drops into food storage compartment 37 from elongated supply duct 114. Moreover, as schematically shown in FIG. 5 for example, elongated cool air supply duct 114 is disposed across from upper louvers 94 of the one condiment plenum wall 72 and is disposed at substantially the same height as upper louvers 94.

In an alternative embodiment of the elongated cool air supply duct 114 of the food preparation table embodiment of FIGS. 4, 5, and 7 for example, an auxiliary fan 39 is enclosed. As schematically shown in FIGS. 5A and 5B for example, fan 39 is configured and disposed to draw cooled air into duct 114 through an elongated slotted opening 41, which defines an entrance into elongated cool air supply duct 114. Auxiliary fan 39 also is configured and disposed to move cool air from within elongated cool air supply duct 114 through a plurality of louvered slots 124, which permit the cool air to enter into food storage compartment 37 from supply duct 114. As schematically shown in FIGS. 5A and 5B for example, louver openings 124 are defined in a grille plate 47, which is generally disposed centrally of cabinet 24.

In accordance with the present invention, means are provided to facilitate even distribution of the supply of cool air into the various sections of the condiment plenum. As shown in the embodiments of FIGS. 2, 2A, 3 and 6 for example, elongated cool air supply duct 114 desirably is provided with a full baffle 116 which functions to distribute the forced cool air evenly along the length of elongated duct 114 and toward upper supply channel 106 of a first condiment plenum wall 70.

Figure 8:
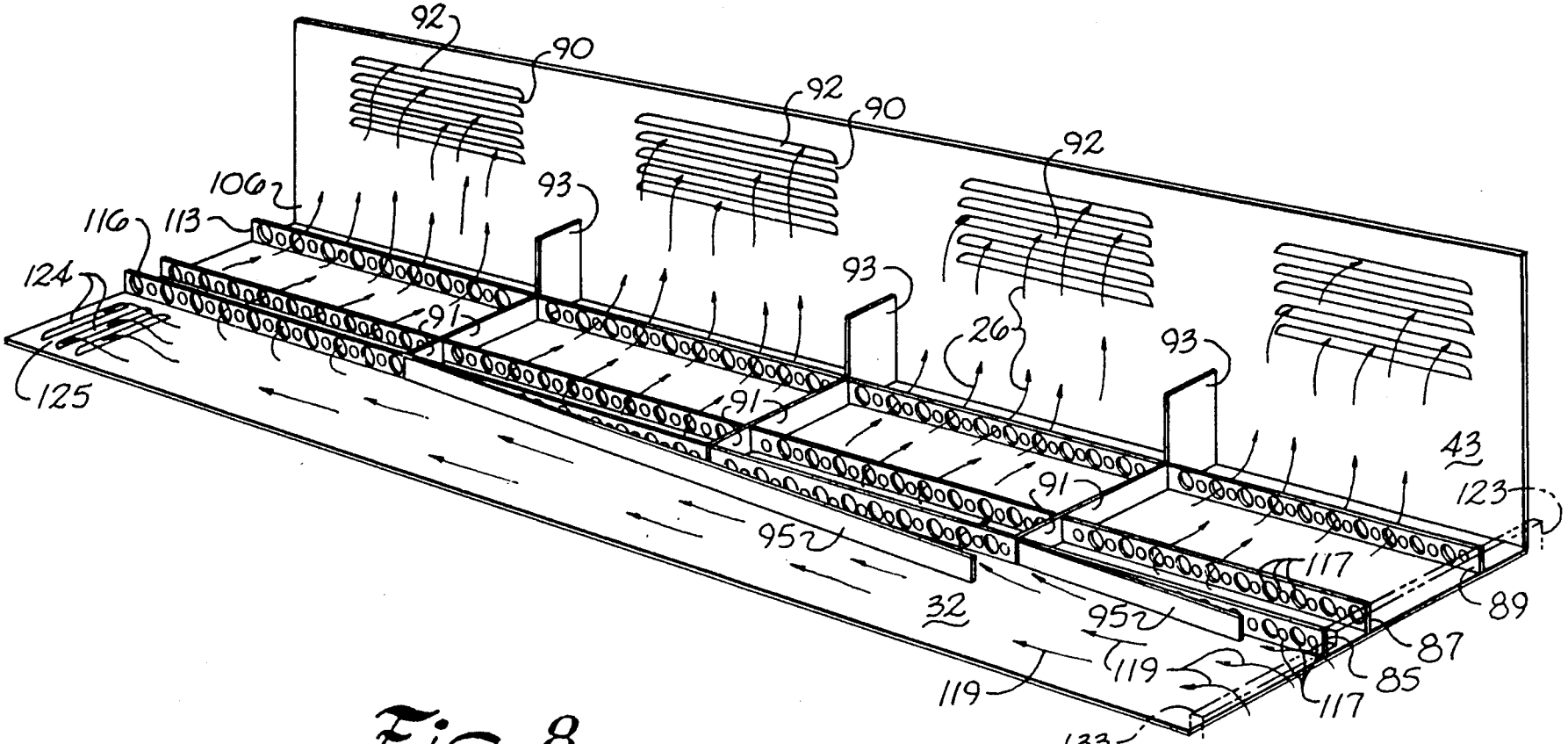
FIG. 8 schematically illustrates an elevated perspective view of selected components of the preferred embodiment of the present invention such as shown in FIGS. 1, 2, 3 and 6 with other components removed and with the short arrows indicating the direction of air flow.

In the FIG. 2A embodiment, full baffle 116 also distributes the forced cool air evenly along the length of elongated duct 114 into lower supply channel 108 of condiment plenum wall 70. A preferred form of full baffle 116 is shown in FIGS. 2, 3, 6 and 8 for example and serves the additional purpose of providing structural support beneath the food preparation surface of countertop 26. As schematically shown in FIGS. 6 and 8 for example, this preferred full baffle embodiment 116 defines an elongated member having a generally U-shaped cross-section. A plurality of nonaligned holes 117 is defined through the opposite leg portions 85, 87 of member 116 (only one broken section of its full length is shown in FIG. 3 in order to avoid obscuring the arrows showing the direction of forced air flow and the louvers 125 behind openings 124). As shown in FIG. 8 (wherein the upper supporting flange shown in FIG. 6 has been omitted to facilitate explanation of the function of baffles 116 and 113) for example, each opposed leg 85, 87 of full baffle 116 is provided along its length with a plurality of alternately sized holes 117. Each adjacent hole 117 in one of the legs 85, 87 is sized with a diameter different than its neighboring hole so that odd-occurring holes 117 are sized the same, and even-occurring holes 117 are sized the same. Moreover, the holes 117 which are opposite one another in legs 85, 87 are sized differently so that a hole 117 in leg 85 will be sized differently than the hole disposed oppositely in leg 87.

As shown in the embodiment of FIG. 5 for example, air supply channel 110 desirably is provided with a full baffle 116 which functions to distribute the forced cool air evenly along the length of air channel 110 and into lower louver openings 104 and upper louver openings 96 of the at least one condiment plenum wall 72.

As shown schematically in FIGS. 2, 6 and 8 for example, elongated cool air supply duct 114 desirably is provided with a half baffle 113 which functions to distribute the forced cool air evenly into upper supply channel 106 of front condiment plenum wall 70. A preferred form of half baffle 113 is shown in FIGS. 2, 6 and 8 for example and serves the additional purpose of providing structural support beneath the front condiment plenum wall 70. This preferred half baffle embodiment 113 defines an elongated member having a generally Z-shaped cross-section and a plurality of holes 117 defined through the intermediate leg portion 89 of member 113 and aligned along its full length.

As schematically shown in FIG. 8 for example, the alignment of holes 117 of intermediate leg portion 89 of half baffle 113 continues the alternating size regime of full baffle 116 so that a smaller hole 117 in half baffle 113 will be disposed opposite a larger hole 117 of the opposed leg 87 of full baffle 116. Thus, desirably, the even distribution means of the cool air supply system can include a full baffle disposed parallel to and in series with a half baffle through which the air must travel before being distributed into air channel 106 of the condiment plenum wall 70.

Moreover, the even distribution means can include a plurality of transverse air flow dams 91 disposed transversely between full baffle 116 and half baffle 113 and being spaced along the length of elongated cool air supply duct 114. Furthermore, aligned with each transverse air flow dam 91 is a vertically disposed air flow dam 93, which divides the lower portions of air channel 106 into different compartments. Each vertically disposed air flow dam 93 terminates beneath the upper portion of interior wall panel 43 where louver openings 92 are formed. The transverse air flow dams 91 and vertically disposed air flow dams 93 cooperate to equalize the pressure losses of the air flowing toward air channel 106 in each section of elongated cool air supply duct 114. This helps ensure a more even distribution of cool air along the length of supply duct 114 and within each section of air channel 106. This ultimately provides more even distribution of cooling air to condiment plenum 66 and prevents unacceptable temperature gradients within the condiment pans.

Moreover, depending upon the length of elongated cool air supply duct, one or more elongated air flow guides 95 is disposed generally at a small angle from being parallel to the length of full baffle 116. As schematically shown in FIG. 8 for example, each air flow guide is disposed to extend from a site at leg 85 where a transverse air flow dam 91 joins with the first baffle, which in this instance is full baffle 116, and deviates from a direction parallel to the baffle by only a small angle of about less than 5 degrees. Desirably, the angle between air flow guide 95 and opposed leg 85 of baffle 116 is about 2 degrees. Air flow guides 95 provide greater pressure losses at locations closer to where evaporator fan 56 propels the cool air into elongated cool air supply duct 114 and thus ensures more even distribution of the cool air along the length of elongated cool air supply duct 114 and an adequate supply of cool air to cool air supply openings 124 formed in ceiling wall 32 of food storage compartment 27 at the far end of cool air supply duct 114. The reader will note in FIG. 8 that exterior wall panel 43 has been removed for the sake of clarity to avoid unduly complicating this drawing.

As embodied herein and shown in FIGS. 3 and 6 for example, fan 56 forces cool air (denoted by arrows 60) out of a discharge face 118 of evaporator 58 and into a cooling plenum 120 defined within cabinet 24. Cooled air from cooling plenum 120 is forced into an entrance opening 121 defined through a horn-shaped section 122 of elongated supply duct 114 disposed near evaporator 58. Fan 56 forces this cooled air to travel through horn-shaped section 122. The cooled air then travels through an opening 133 defined in a flange 123 (shown in phantom by dashed lines in FIG. 8) forming an air flow restriction in elongated cool air supply duct 114 and thence along the length of elongated supply duct 114 (denoted by arrows 119 in FIGS. 3 and 6). (The reader will note the omission of air flow guide 95, which was omitted to avoid unduly complicating FIGS. 3 and 6.) Whereupon the cool air enters food storage compartment 27 via one or more supply openings 124 disposed in the ceiling wall 32 of food storage compartment 27. As shown schematically in FIGS. 3 and 8 for example, each of these storage compartment cool air supply openings 124 desirably is formed as an elongated slotted opening through which the cool air flows into food storage compartment 27 at the end of a directional louver 125. Louvers 125 are similar in configuration to upper louvers 90, 94 shown in FIG. 6 for example. Louvers 125 extend into elongated supply duct 114 and regulate the amount of cooled air that is supplied to food storage compartment 27. Supply openings 124 desirably are grouped at the end of compartment 27 that is farthest from evaporator fans 56.

As embodied herein and schematically shown in one or more of FIGS. 2, 2A, 3, 6 and 8 for example, not only does cool air become distributed lengthwise along the length of elongated supply duct 114, full baffle 116 and half baffle 113 distribute the cooled air substantially evenly toward condiment plenum 66 and into upper supply channel 106 of front condiment plenum wall 70. In the FIG. 2A embodiment, there is no half baffle, but full baffle 116 also distributes the forced cool air into lower supply channel 108 of front condiment plenum wall 70.

As schematically shown in FIGS. 2, 2A, 6 and 8 by arrows 126, cooled forced air entering upper supply channel 106 of front condiment plenum wall 70 through distribution holes 117 of half baffle 113, exits channel 106 via upper louver openings 92 and is directed across the upper portion of condiment pans 80 and across the upper surface 128 (not shown in FIGS. 6 and 8) of the foodstuffs contained in condiment pans 80. As schematically shown in FIGS. 2, 2A and 6 by arrows 130, after encountering the foodstuffs 128 contained in condiment pans 80, this now relatively warmed air (compared to when it exited louver openings 92), enters upper louver openings 96 of rear plenum wall 72 and passes into upper return channel 110 of rear wall 72.

Similarly, as schematically shown in FIG. 2A by arrows 132, cool forced air entering lower supply channel 108 of front condiment plenum wall 70 exits channel 108 via lower louver openings 100 and travels around the vertical side walls 84 of condiment pans 80. The air then travels through the air space 88 defined beneath condiment pan bottom walls 86 and above bottom plenum wall 74 and passes around the opposite vertical side walls 84 of condiment pans 80. Finally, as schematically shown in FIG. 2A by arrows 134, the relatively warmed air enters lower louver openings 104 in the lower portion of rear condiment plenum wall 72 and passes into return channel 112 of rear plenum wall 72.

Referring to the embodiment shown in FIG. 5 for example, fan 56 draws cool air out of a discharge face 118 of evaporator 58 and into cooling plenum 120 defined within and running along the length of cabinet 24. Cooling plenum 120 communicates with upper supply channel 110 via distribution holes 117 of a full baffle 116, which is disposed at the entrance of cool air supply channel 110. Fan 56 then forces the cooled air from cooling plenum 120 to become distributed along the length of channel 110 after passing through distribution holes 117. The cooled air fills channel 110 and exits through upper louver openings 96. As schematically shown in FIGS. 5 and 7 by arrows 126, cooled forced air exiting upper louver openings 96 is directed across the upper portion of condiment pans 80 and across the upper surface (not shown) of the foodstuffs contained in condiment pans 80. As schematically shown in FIGS. 5 and 7 by arrows 127, the air passing across condiment pans 80 enters into elongated supply duct 114. Whereupon as schematically shown in FIGS. 5 and 7, the cool air in supply duct 114 drops through at least a pair of, and desirably three, side-by-side slotted openings 115 and enters food storage compartment 37.

Similarly, as schematically shown in FIG. 5 by arrows 132, cool forced air entering upper supply channel 110 of rear condiment plenum wall 72 also exits channel 110 via lower louver openings 104 and travels around the vertical side walls 84 of condiment pans 80. The air then travels through the air space 88 defined beneath condiment pan bottom walls 86 and above bottom condiment plenum wall 74 and passes into food storage compartment 37.

In still further accordance with the present invention, the cabinet further defines a return air system. Relatively warmed air from the food storage compartment and the condiment plenum are returned to the evaporator by the return air system upon operation of the at least one fan so that the relatively warmed air can be recooled. The return air system includes a return chamber configured and disposed in communication with both the food storage compartment and the evaporator. Desirably, the return system includes a return wall and at least one return opening defined through the return wall to permit air from the food storage compartment to communicate with and enter into the return chamber.

In one preferred embodiment of the return air system shown in FIGS. 2, 2A and 6 for example, arrows 136 schematically indicate relatively warmed air from upper return channel 110 of rear condiment plenum wall 72 being collected in a return conduit 138 disposed beneath bottom condiment plenum wall 74. Similarly, as schematically shown in FIG. 2A, arrows 134 indicate relatively warmed air from lower return channel 112 of rear condiment plenum wall 72 being collected in return conduit 138. Conduit 138 is sized to run along the length of the condiment plenum and has about the width of condiment plenum 66.

As schematically shown in FIGS. 3 and 6 for this one preferred embodiment of the return air system, a return chamber 140 is defined beneath ceiling wall 32 of compartment 27 and above top wall 51 (not shown in FIG. 6) of housing 52 and contains at least one fan 56. Arrows 135 in FIG. 6 schematically illustrate how relatively warmed air would move from return conduit 138 past a flange 129 disposed at the entrance of return air chamber 140 and thence drop into return air chamber 140. Desirably, as shown in FIGS. 3, 5 and 6 for example, return chamber 140 is separated from cooling plenum 120 by evaporator 58. As schematically shown in FIGS. 3 and 6 for example, return air chamber 140 receives relatively warmed air designated by arrows 135 and collects this relatively warmed return air adjacent fan 56, which moves the return air back through evaporator 58 for recooling and recycling through the cool air supply system.

As schematically shown in FIG. 6, a separation flange 131 is disposed between return conduit 138 and horn-shaped section 122 of elongated cool air supply duct 114. This separation flange 131 is configured and disposed to separate the relatively cool supply air from the relatively warmed return air as they move in opposite directions, toward and away from evaporator 58.

The food storage compartment defines at least one return opening that forms part of the return air system. As embodied herein and schematically shown in FIG. 3 for a first preferred embodiment, a return opening in the form of an elongated slot 143 is defined through a return wall 142 of food storage compartment 27 and provides access to fan 56, which is disposed within return chamber 140. As schematically shown in FIG. 3 for example, fan 56 draws relatively warmed air indicated by arrows 61 through slot 143 into return air chamber 140 from food storage compartment 27. Whereupon fan 56 can move the return air back through evaporator 58 for recooling and recycling through the cool air supply system.

In a second preferred embodiment of the return air system shown in FIG. 5 for example, return air chamber 140 is defined in front of evaporator 58 and above top wall 51. As shown in FIGS. 4 and 5 for example, a return wall 142 defines a back wall of food storage compartment 37 and a front access wall for return chamber 140. As schematically shown in FIG. 5 for example, return air indicated by arrows designated 61 must encounter evaporator 58 and evaporator fan 56 before entering cooling plenum 120 and thus return chamber is separated from cooling plenum 120 by evaporator 58.

As embodied herein and schematically shown in FIGS. 4 and 5 for example, return wall 142 defines a plurality of louvered return openings 144 that form part of the return air system. Each louvered opening desirably is formed as an elongated slit defined through return wall 142. Relatively warmed air indicated by arrows 61 in FIG. 5 is drawn into return air chamber 14 from food storage compartment 37 by fan 56. Whereupon fan 56 can move the return air through evaporator 58 for recooling and recycling through the cool air supply system.

Note that food storage compartment 37 of cabinet 24 shown in FIG. 4 for example, can include a longer length than compartment 27 of the FIG. 3 embodiment and thus will typically have a shorter depth dimension from front to back in order to accommodate the heat-generating refrigeration equipment housing 52 as well as the return chamber 140 and cooling plenum 120. Typically, the depth of the FIG. 3 food storage compartment 27 embodiment is about 32 inches, while the depth of the FIG. 5 food storage compartment 37 embodiment is about 27 inches. In embodiments of this size, the evaporator fans typically move about 100 cubic feet of air flow per minute during operation of the cooling mode of the refrigeration equipment.

What is claimed is:

1. An apparatus for counter top preparation of selected refrigeration foodstuffs into a prepared food product, the apparatus comprising:

a cabinet, said cabinet defining a food preparation surface, said food preparation surface being an elongated exterior top surface of said cabinet and extending generally along the length of said cabinet and disposed generally horizontally at a height convenient for preparing food;

said cabinet defining at least one heat insulated, food storage compartment disposed beneath said food preparation surface, said cabinet defining a door for gaining access inside said storage compartment;

heat-absorbing refrigeration equipment disposed inside said cabinet, said refrigeration equipment including at least one fan and an evaporator disposed so that air moved by operation of said fan moves through said evaporator;

said cabinet defining a condiment plenum disposed adjacent to one elongated side edge of said food preparation surface and including at least one condiment plenum wall spaced away from said elongated side edge of said food preparation surface, said condiment plenum defining a bottom extending from said at least one condiment plenum wall toward said elongated side edge of said food preparation surface, said condiment plenum being configured to receive at least one open top condiment pan for holding foodstuffs to be used in preparing food on said food preparation surface;

at least one open top condiment pan received by said condiment plenum;

said at least one condiment plenum wall defining a complex wall structure, said complex wall structure including at least one upper louver defined in the upper region of said at least one condiment plenum wall, said upper louver being configured and disposed to face toward said condiment pan, and said upper louver being disposed above said open top of said condiment pan; and wherein:

said upper louver of said at least one condiment plenum wall is disposed at a height below said elongated side edge of said food preparation surface.

2. An apparatus as in claim 1, wherein:

said cabinet further defining a return air system, said return air system including a return chamber;

said cabinet further defining a return wall disposed between said food storage compartment and said return chamber, said return wall defining at least one return opening permitting access between said food storage compartment and said return chamber; and said return chamber and said at least one return opening being configured and disposed to return to said evaporator upon operation of said at least one fan relatively warmed air from said food storage compartment.

3. An apparatus as in claim 1, wherein:

at least one cover is pivotally mounted to the top of said cabinet, said at least one cover defining a hood pivotally mounted such that the weight of said hood is balanced to maintain said hood in a stable position at each opposite extreme position of pivotal movement of said hood, wherein one extreme position of pivotal movement of said hood allows access to said condiment plenum and the opposite extreme position of pivotal movement of said hood prevents access to said condiment plenum.

4. An apparatus for counter top preparation of selected refrigerated foodstuffs into a prepared food product, the apparatus comprising:

a cabinet, said cabinet defining a food preparation surface, said food preparation surface being an elongated exterior top surface of said cabinet and extending generally along the length of said cabinet and disposed generally horizontally at a height convenient for preparing food:

said cabinet defining at least one heat insulated, food storage compartment disposed beneath said food preparation surface, said cabinet defining a door for gaining access inside said storage compartment;

heat-absorbing refrigeration equipment disposed inside said cabinet, said refrigeration equipment including at least one fan and an evaporator disposed so that air moved by operation of said fan moves through said evaporator;

said cabinet defining a condiment plenum disposed adjacent to one elongated side edge of said food preparation surface and including at least one condiment plenum wall spaced away from said elongated side edge of said food preparation surface, said condiment plenum defining a bottom extending from said at least one condiment plenum wall toward said elongated side edge of said food preparation surface, said condiment plenum being configured to receive at least one open top condiment pan for holding foodstuffs to be used in preparing food on said food preparation surface;

at least one open top condiment pan received by said condiment plenum; and said at least one condiment plenum wall defining a complex wall structure, said complex wall structure including at least one upper louver defined in the upper region of said at least one condiment plenum wall, said upper louver being configured and disposed to face toward said condiment pan, and said upper louver being disposed above said open top of said condiment pan, wherein:

said cabinet further defining a cool air supply system, said cool air supply system including:

aid upper louver, an air channel defined within said at least one condiment plenum wall and configured and disposed to communicate with said upper louver, a cooling plenum configured and disposed to receive air passing through said evaporator upon operation of said at least one fan, an elongated cool air supply duct, and at least one supply opening configured and disposed to connect said elongated cool air supply duct with said food storage compartment, and wherein upon operation of said at least one fan, said cooling plenum, said elongated cool air supply duct, said upper louver, said air channel, and said at least one supply opening are configured and disposed to supply from said evaporator cool air access the top of said condiment pan and cool air into said food storage compartment.

5. An apparatus as in claim 4, wherein:

said cool air supply system further includes an auxiliary fan configured and disposed in said elongated cool air supply duct to move air from said condiment plenum into said food storage compartment via said elongated cool air supply duct.

6. An apparatus as in claim 4, wherein:

said elongated cool air supply duct is configured and disposed to communicate with said air channel defined within said at least one condiment plenum wall to supply cool air to said condiment plenum via said upper louver.

7. An apparatus as in claim 6, further comprising:

an elongated air flow baffle disposed along the length of said elongated cool air supply duct and configured to facilitate more even distribution of air flow along the length of said elongated cool air supply duct.

8. An apparatus as in claim 4, wherein:

said at least one supply opening configured and disposed to connect said elongated supply duct with said food storage compartment defines a slotted opening defined between a pair of condiment pan support members disposed to extend toward said at least one condiment plenum wall.

9. An apparatus as in claim 8, further comprising:

an elongated air flow baffle disposed along the length of said air channel defined within said at least one condiment plenum wall, said air flow baffle being configured to facilitate more even distribution of air flow along the length of said air channel.

10. An apparatus as in claim 4, wherein:

said cabinet further defines a second condiment plenum wall disposed spaced apart from said at least one condiment plenum wall, said second condiment plenum wall further defining said condiment plenum, said second condiment plenum wall further defining a complex wall structure, said complex wall structure of said second condiment plenum wall further defining an air channel, said complex wall structure of said second condiment plenum wall further defining at least one upper louver disposed in an upper portion of said complex wall structure of said second condiment plenum wall and communicating with said air channel of said second condiment plenum wall;

each of said complex wall structures of each of said condiment plenum walls defines at least one lower louver disposed in a lower region of each said condiment plenum wall;

said lower louvers being configured and disposed to communicate with said condiment plenum beneath the top of said condiment pan;

said lower louver of one of said condiment plenum walls forming part of said cool air supply system;

said upper louver of one of said condiment plenum walls forming part of said cool air supply system; and wherein upon operation of said at least one fan, said cooling plenum, said elongated cool air supply duct, said upper louver of said one of said condiment plenum walls forming part of said cool air supply system, said lower louver of said one of said condiment plenum walls forming part of said cool air supply system, at least one of said air channels, and said at least one supply opening are configured and disposed to supply from said evaporator cool air across the top of said condiment pan and beneath the top and outside of said condiment pan and cool air into said food storage compartment.

11. An apparatus for counter top preparation of selected refrigerated foodstuffs into a prepared food product, the apparatus comprising:

a cabinet, said cabinet defining a food preparation surface, said food preparation surface being an elongated exterior top surface of said cabinet and extending generally along the length of said cabinet and disposed generally horizontally at a height convenient for preparing food;

said cabinet defining at least one heat insulated, food storage compartment disposed beneath said food preparation surface, said cabinet defining a door for gaining access inside said storage compartment;

heat-absorbing refrigeration equipment disposed inside said cabinet, said refrigeration equipment including at least one fan and an evaporator disposed so that air moved by operation of said fan moves through said evaporator;

said cabinet defining a condiment plenum disposed adjacent to one elongated side edge of said food preparation surface and including at least one condiment plenum wall spaced away from said elongated side edges of said food preparation surface, said condiment plenum defining a bottom extending from said at least one condiment plenum wall toward said elongated said edge of said food preparation surface, said condiment plenum being configured to receive at least one open top condiment pan for holding foodstuffs to be used in preparing food on said food preparation surface;

at least one open top condiment pan received by said condiment plenum; and said at least one condiment plenum wall defining a complex wall structure, said complex wall structure including at least one upper louver defined in the upper region of said at least one condiment plenum wall, said upper louver being configured and disposed to face toward said condiment pan, and said upper louver being disposed above said open top of said condiment pan, wherein:

said cabinet further defining a cool air supply system, said cool air supply system including:

said upper louver, at least one lower louver defined in the lower region of said at least one condiment plenum wall and disposed below said open top of said condiment pan, an air channel defined within said at least one condiment plenum wall and configured and disposed to communicate with said upper louver and said lower louver, a cooling plenum configured and disposed to receive air passing through said evaporator upon operation of said at least one fan, an elongated cool air supply duct, and at least one supply opening configured and disposed to connect said elongated supply duct with said food storage compartment, and wherein upon operation of said at least one fan, said cooling plenum, said supply duct, said upper louver, said lower louver, said air channel, and said at least one opening are configured and disposed to supply cool air from said evaporation to completely surround said condiment pan and into said food storage compartment.

12. An apparatus for counter top preparation of selected refrigerated foodstuffs into a prepared food product, the apparatus comprising:

a cabinet, said cabinet defining a food preparation surface, said food preparation surface being an elongated exterior top surface of said cabinet and extending generally along the length of said cabinet and disposed generally horizontally at a height convenient for preparing food;

said cabinet defining at least one heat insulated, food storage compartment disposed beneath said food preparation surface, said cabinet defining a door for gaining access inside said storage compartment;

heat-absorbing refrigeration equipment disposed inside said cabinet, said refrigeration equipment including at least one fan and an evaporator disposed so that air moved by operation of said fan moves through said evaporator;

said cabinet defining a condiment plenum disposed adjacent to one elongated side edge of said food preparation surface and including at least one condiment plenum wall spaced away from said elongated side edge of said food preparation surface, said condiment plenum defining a bottom extending from said at least one condiment plenum wall toward said elongated side edge of said food preparation surface, said condiment plenum being configured to receive at least one open top condiment pan for holding foodstuffs to be used in preparing food on said food preparation surface;

at least one open top condiment pan received by said condiment plenum;

said at least one condiment plenum wall defining a complex wall structure, said complex wall structure including at least one upper louver defined in the upper region of said at least one condiment plenum wall, said upper louver being configured and disposed to face toward said condiment pan, and said upper louver being disposed above said open top of said condiment pan;

an elongated cool air supply duct configured and disposed to conduct cool air from said evaporator into said at least one condiment plenum wall; and an elongated air flow baffle disposed along the length of said elongated cool air supply duct and configured to facilitate more even distribution of air flow along the length of said elongated cool air supply duct.

13. An apparatus as in claim 12, further comprising:

at least one air flow dam disposed transversely across said elongated cool air supply duct and said baffle to compartmentalize same.

14. An apparatus as in claim 12, further comprising:

at least one air flow dam disposed vertically inside the lower portion of said at least one condiment plenum wall to compartmentalize same.

15. An apparatus as in claim 12, further comprising:

at least one elongated air flow guide having one end connected to said baffle, said at least one elongated air flow guide being disposed to extend at an angle less than 5 degrees from said baffle.

16. An apparatus for counter top preparation of selected refrigerated foodstuffs into a prepared food product, the apparatus comprising:

a cabinet, said cabinet defining a food preparation surface, said food preparation surface being an elongated exterior top surface of said cabinet and extending generally along the length of said cabinet and disposed generally horizontally at a height convenient for preparing food;

said cabinet defining at least one heat insulated, food storage compartment disposed beneath said food preparation surface, said cabinet defining a door for gaining access inside said storage compartment;

heat-absorbing refrigeration equipment disposed inside said cabinet, said refrigeration equipment including at least one fan and an evaporator disposed so that air moved by operation by said fan moves through said evaporator;

said cabinet defining a condiment plenum disposed adjacent to one elongated side edge of said food preparation surface and including at least one condiment plenum wall spaced away from said elongated side edge of said food preparation surface, said condiment plenum defining a bottom extending from said at least one condiment plenum wall toward said elongated side edge of said food preparation surface, said condiment plenum being configured to receive at least one open top condiment pan for holding foodstuffs to be used in preparing food on said food preparation surface;

at least one open top condiment pan received by said condiment plenum;

said at least one condiment plenum wall defining a complex wall structure, said complex wall structure including at least one upper louver defined in the upper region of said at least one condiment plenum wall, said upper louver being configured and disposed to face toward said condiment pan, and said upper louver being disposed above said open top of said condiment pan;

said cabinet further defining a second condiment plenum wall disposed spaced apart from said at least one condiment plenum wall, said second condiment plenum wall further defining said condiment plenum, said second condiment plenum wall further defining a complex wall structure, said complex wall structure of said second condiment plenum wall further defining an air channel, said complex wall structure of said second condiment plenum wall further defining at least one upper louver disposed in an upper portion of said complex wall structure of said second condiment plenum wall and communicating with said air channel of said second condiment plenum wall;

a refrigeration system, said refrigeration system being disposed inside said cabinet in a housing that is heat insulated from said food storage compartment, said refrigeration system including a compressor for compressing the coolant that is supplied to said evaporator; and a temperature controller, said controller having temperature sensing means and being electrically connected to said compressor and configured for controlling operation of said compressor in a cooling mode when said temperature sensing means senses a temperature higher than a preselected temperature, said controller being electrically connected to said evaporator fan and configured for limiting operation of said fan to such times when said compressor is operating.

17. An apparatus for counter top preparation of selected refrigerated foodstuffs into a prepared food product, the apparatus comprising:

a cabinet, said cabinet defining a food preparation surface, said food preparation surface being an elongated exterior top surface of said cabinet and extending generally along the length of said cabinet and disposed generally horizontally at a height convenient for preparing food;

said cabinet defining at least one heat insulated, food storage compartment disposed beneath said food preparation surface, said cabinet defining a door for gaining access inside said storage compartment;

heat-absorbing refrigeration equipment disposed inside said cabinet, said refrigeration equipment including at least one fan and an evaporator disposed so that air moved by operation of said fan moves through said evaporator;

said cabinet defining a condiment plenum disposed adjacent to one elongated side edge of said food preparation surface and including at least one condiment plenum wall spaced away from said elongated side edge of said food preparation surface, said condiment plenum defining a bottom extending from said at least one condiment plenum wall toward said elongated side edge of said food preparation surface, said condiment plenum being configured to receive at least one open top condiment pan for holding foodstuffs to be used in preparing food on said food preparation surface;

at least one open top condiment pan received by said condiment plenum; and said at least one condiment plenum wall defining a complex wall structure, said complex wall structure including at least one upper louver defined in the upper region of said at least one condiment plenum wall, said upper louver being configured and disposed to face toward said condiment pan, and said upper louver being disposed above said open top of said condiment pan, wherein:

said cabinet further defining a returning air system, said return air system including a return chamber;

said cabinet further defining a return wall disposed between said food storage compartment and said return chamber, said return wall defining at least one return opening permitting access between said food storage compartment and said return chamber;

said return chamber and said at least one return opening being configured and disposed to return to said evaporator upon operation of said at least one fan relatively warmed air from said food storage compartment;

said cabinet further defines a second condiment plenum wall disposed spaced apart from said at least one condiment plenum wall, said second condiment plenum wall further defining said condiment plenum, said second condiment plenum wall further defining a complex wall structure, said complex wall structure of said second condiment plenum wall further defining an air channel, said complex wall structure of said second condiment plenum wall further defining at least one upper louver disposed in an upper portion of said complex wall structure of said second condiment plenum wall and communicating with said air channel of said second condiment plenum wall; and said return air system further comprising an elongated return conduit configured and disposed in communication with one of said channels of one of said condiment plenum walls, and said elongated return conduit being further configured and disposed in communication with said return chamber.

18. An apparatus as in claim 17, wherein:

each of said complex wall structure of each of said condiment plenum walls defines at least one lower louver disposed in a lower region of each said condiment plenum wall, said lower louver being configured and disposed to communication with said condiment plenum beneath the top of said condiment pan, and said lower louver of one of said condiment plenum walls forming part of said return air system.

19. An apparatus for counter top preparation of selected refrigerated foodstuffs into a prepared food product, the apparatus comprising:

a cabinet, said cabinet defining a food preparation surface, said food preparation surface being an elongated exterior top surface of said cabinet and extending generally along the length of said cabinet and disposed generally horizontally at a height convenient for preparing food;

said cabinet defining at least one heat insulated, food storage compartment disposed beneath said food preparation surface, said cabinet defining a door for gaining access inside said storage compartment;

heat-absorbing refrigeration equipment disposed inside said cabinet, said refrigeration equipment including at least one fan and an evaporator disposed so that air moved by operation of said fan moves through said evaporator;

said cabinet defining a condiment plenum disposed adjacent to one elongated side edges of said food preparation surface and including at least one condiment plenum wall spaced away from said elongated side edge of said food preparation surface, said condiment plenum defining a bottom extending from said at least one condiment plenum wall toward said elongated side edge of said food preparation surface, said condiment plenum being configured to receive at least one open top condiment pan for holding foodstuffs to be used in preparing food on said food preparation surface;

at least one open top condiment pan received by said condiment plenum; and said at least one condiment plenum wall defining a complex wall structure, said complex wall structure including at least one upper louver defined in the upper region of said at least one condiment plenum wall, said upper louver being configured and disposed to face toward said condiment pan, and said upper louver being disposed above said open top of said condiment pan, wherein:

said complex wall structure of said at least one condiment plenum wall defines at least one lower louver disposed in a lower region of said at least one condiment plenum wall, said complex wall structure of said at least one condiment plenum wall further defines an air channel within said at least one condiment plenum wall and configured and disposed to communicate with said upper louver and said lower louver, said cabinet further defining a cool air supply system, said supply system including a cooling air plenum configured and disposed to supply cool air from said evaporator into said channel of said at least one wall of said condiment plenum to completely surround said condiment pan and into said food storage compartment upon operation of said at least one fan.

20. An apparatus as in claim 19, wherein:

said cool air supply system includes an elongated supply duct disposed beneath and extending along a substantial portion of the length of said food preparation surface, said cool air supply duct being disposed across from said upper louver of said at least one condiment plenum wall and disposed at substantially the same height as said upper louver of said at least one condiment plenum wall.

21. An apparatus as in claim 20, wherein:

said cabinet defines at least one condiment pan support member disposed beneath said elongated supply duct and disposed in the upper portion of said food storage compartment and extending toward said at least one condiment plenum wall, and wherein each said support member is disposed between and partially defines a pair of adjacent slotted openings connecting said elongated supply duct with said food storage compartment.

22. An apparatus for counter top preparation of selected refrigerated foodstuffs into a prepared food product, the apparatus comprising:

a cabinet, said cabinet defining a food preparation surface, said food preparation surface being an elongated exterior top surface of said cabinet and extending generally along the length of said cabinet and disposed generally horizontally at a height convenient for preparing food:

said cabinet defining at least one heat insulated, food storage compartment disposed beneath said food preparation surface, said cabinet defining a door for gaining access inside said storage compartment;

heat-absorbing refrigeration equipment disposed inside said cabinet, said refrigeration equipment including at least one fan and an evaporator disposed so that air moved by operation of said fan moves through said evaporator;

said cabinet defining a condiment plenum disposed adjacent to one elongated side edge of said food preparation surface and including at least one condiment plenum wall spaced away from said elongated side edge of said food preparation surface, said condiment plenum defining a bottom extending from said at least one condiment plenum wall toward said elongated side edge of said food preparation surface, said condiment plenum being configured to receive at least one open top condiment pan for holding foodstuffs to be used in preparing food on said food preparation surface;

at least one open top condiment pan received by said condiment plenum; and said at least one condiment plenum wall defining a complex wall structure, said complex wall structure including at least one upper louver defined in the upper region of said at least one condiment plenum wall, said upper louver being configured and disposed to face toward said condiment pan, and said upper louver being disposed above said open top of said condiment pan, wherein:

said complex all structure of said at least one condiment plenum wall including at least one lower louver defined in the lower region of said at least one condiment plenum wall, said lower louver being configured and disposed to face toward said condiment plenum, each said condiment pan defining a bottom and being configured so as to leave an air space between said pan bottom and said condiment plenum bottom when each said pan is disposed in said condiment plenum, said lower louver being disposed below said open top of said condiment pan and in communication with said air space disposed between said condiment plenum bottom and said bottom of said condiment pan.

23. An apparatus as in claim 22, wherein:

said cabinet further defining a return air system, said return air system including a return chamber, said cabinet further defining a return wall disposed between said food storage compartment and said return chamber, said return wall defining at least one return opening permitting access between said food storage compartment and said return chamber; and said return chamber and said at least one return opening being configured and disposed to return to said evaporator upon operation of said at least one fan relatively warmed air from said food storage compartment.

24. An apparatus as in claim 22, wherein:

said cabinet further defining a cool air supply system and a return air system;

said cool air supply system including:

a cooling plenum, an elongated cool air supply duct, said upper louver, said lower louver, an air channel defined within said at least one condiment plenum wall and configured and disposed to communicate with said upper louver and said lower louver, and at least one supply opening configured and disposed to connect said elongated supply duct with said food storage compartment, and wherein said cooling plenum, said supply duct, said upper louver, said lower louver, said air channel, and said at least one supply opening are configured and disposed to supply from said evaporator cool air to said condiment pan and into said food storage compartment upon operation of said at least one fan; and said return air system including:

a return chamber, a return wall disposed between said food storage compartment and said return chamber, at least one return opening defined in said return wall in a configuration permitting access between said food storage compartment and said return chamber, wherein said return chamber, said return wall, and said at least one return opening being configured and disposed to return relatively warmed air from said food storage compartment to said evaporator upon operation of said at least one fan.

25. An apparatus for counter top preparation of selected refrigerated foodstuffs into a prepared food product, the apparatus comprising:

a cabinet, said cabinet defining a food preparation surface, said food preparation surface being an elongated exterior top surface of said cabinet and extending generally along the length of said cabinet and disposed generally horizontally at a height convenient for preparing food;

said cabinet defining at least one heat insulated, food storage compartment disposed beneath said food preparation surface, said cabinet defining a door for gaining access inside said storage compartment;

heat-absorbing refrigeration equipment disposed inside said cabinet, said refrigeration equipment including at least one fan and an evaporator disposed so that air moved by operation of said fan moves through said evaporator;

said cabinet defining a condiment plenum disposed adjacent to one elongated side edge of said food preparation surface and including at least one condiment plenum wall spaced away from said elongated side edge of said food preparation surface, said condiment plenum defining a bottom extending from said at least one condiment plenum wall toward said elongated side edge of said food preparation surface, said condiment plenum being configured to receive at least one open top condiment pan for holding foodstuffs to be used in preparing food on said food preparation surface;

at least one open top condiment pan received by said condiment plenum; and said at least one condiment plenum wall defining a complex wall structure, said complex wall structure including at least one upper louver defined in the upper region of said at least one condiment plenum wall, said upper louver being configured and disposed to face toward said condiment pan, and said upper louver being disposed above said open top of said condiment pan, wherein:

said cabinet further defines a second wall disposed opposite said at least one condiment plenum wall, said second condiment plenum wall further defining said condiment plenum and defining a complex wall structure, said complex wall structure of each of said opposed condiment plenum walls further defining a pair of air channels, one of said pair of air channels of said second condiment plenum wall being configured and disposed to communicate with said upper louver of said second condiment plenum wall, one of said pair of air channels of said at least one condiment plenum wall being configured and disposed to communicate with said upper louver of said at least one condiment plenum wall, and said cabinet further defining a cool air supply system, said cool air supply system including an elongated cool air supply duct configured and disposed to supply cool air from said evaporator into said food storage compartment and to said channels of one of said condiment plenum walls upon operation of said at least one fan.

26. An apparatus as in claim 25, wherein:

said complex wall structure of said second condiment plenum wall including at least one lower louver defined in the lower region of said second condiment plenum wall, said complex wall structure of said at least one condiment plenum wall including at least one lower louver defined in the lower region of said at least one condiment plenum wall, said lower louvers being configured and disposed to face toward said condiment plenum, each said condiment pan defining a bottom and being configured so as to leave an air space between said pan bottom and said condiment plenum bottom when disposed in said condiment plenum, said lower louvers being disposed below said open top of said condiment pan and in communication with said air space disposed between said condiment plenum bottom and said bottom of said condiment pan.

27. An apparatus as in claim 26, wherein:

said cabinet further defining a return air system, said return system including a return conduit;

said food storage compartment defining at least one return opening; and said return conduit and said return opening being configured and disposed to return to said evaporator upon operation of said at least one fan relatively warmed air from said food storage compartment and from said channels of one of said condiment plenum walls.

28. An apparatus as in claim 26, wherein:

one of said pair of air channels in each of said condiment plenum walls communicates with said lower louver in said respective condiment plenum wall.

29. An apparatus as in claim 28, wherein:

said cabinet further defining a cool air supply system and a return air system;

said cool air supply system including an elongated cool air supply duct configured and disposed to supply cool air from said evaporator into said food storage compartment and to at least one of said channels of one of said condiment plenum walls of said condiment plenum upon operation of said at least one fan; and said return air system including a return conduit configured and disposed to return to said evaporator upon operation of said at least one fan relatively warmed air from said food storage compartment and from at least one of said channels of said other one of said condiment plenum walls of said condiment plenum.

* * * * *